US008010008B2

(12) United States Patent
Mori

(10) Patent No.: US 8,010,008 B2
(45) Date of Patent: Aug. 30, 2011

(54) IMAGE FORMING APPARATUS FOR APPLYING PRESSING FORCE ACTING BETWEEN CLEANING MEMBER AND BELT

(75) Inventor: Hirotaka Mori, Ichinomiya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 12/406,393

(22) Filed: Mar. 18, 2009

(65) Prior Publication Data

US 2009/0185817 A1 Jul. 23, 2009

Related U.S. Application Data

(62) Division of application No. 11/750,578, filed on May 18, 2007, now Pat. No. 7,526,221.

(30) Foreign Application Priority Data

May 31, 2006 (JP) ..... 2006-152455

(51) Int. Cl.
*G03G 21/00* (2006.01)
*G03G 15/16* (2006.01)

(52) U.S. Cl. ..... 399/71; 399/345

(58) Field of Classification Search ..... 399/71, 399/343, 345, 353, 357
See application file for complete search history.

(56) References Cited

U.S. PATENT DOCUMENTS 5,126,798 A * 6/1992 LeRoy et al. ..... 399/349
5,797,078 A * 8/1998 Sass et al. ..... 399/357
6,049,684 A 4/2000 Nishikawa et al.
6,226,489 B1 * 5/2001 Eelen et al. ..... 399/327
2006/0285871 A1 * 12/2006 Kato et al. ..... 399/99
2006/0285872 A1 12/2006 Fukuta et al.
2007/0209539 A1 9/2007 Mori
2008/0056743 A1 * 3/2008 Fukami et al. ..... 399/44

FOREIGN PATENT DOCUMENTS

EP 807870 A2 * 11/1997
JP 62-260181 A 11/1987
JP 6035340 2/1994
JP 6258995 9/1994
JP 8-137357 A 5/1996
JP 2000-181313 A 6/2000
JP 2001109338 4/2001
JP 2004-029392 A 1/2004
JP 2007001680 1/2007
JP 2007033468 A * 2/2007

OTHER PUBLICATIONS

Computer Translation of JP2007-033468A; Feb. 8, 2007.*
Office Action mailed Jan. 6, 2001 in Japanese Patent Application No. 2006-152455 and English translation thereof.

* cited by examiner

*Primary Examiner* — Quana M Grainger
(74) *Attorney, Agent, or Firm* — Banner & Witcoff, Ltd.

(57) ABSTRACT

An image forming apparatus includes a belt, a cleaning member, a backup member, a pressing-force changing mechanism, and a control unit. The cleaning member is disposed in confrontation with the belt. The backup member is disposed to pinch the belt in cooperation with the cleaning member. The pressing-force changing mechanism is configured to change a pressing force acting between the cleaning member and the belt in a state in which the cleaning member is in contact with the belt. The control unit controls the pressing-force changing mechanism to change the pressing force.

18 Claims, 32 Drawing Sheets

IMAGE FORMING APPARATUS FOR APPLYING PRESSING FORCE ACTING BETWEEN CLEANING MEMBER AND BELT

CROSS REFERENCE TO RELATED APPLICATIONS

This application is a continuation of prior U.S. application Ser. No. 11/750,578, filed May 18, 2007, which claims priority from Japanese Patent Application No. 2006-152455 filed May 31, 2006. The entire contents of the prior applications are incorporated herein by reference.

TECHNICAL FIELD

The invention relates to an image forming apparatus, and more particularly to an image forming apparatus having a cleaning member for cleaning a belt.

BACKGROUND

Some laser printers and other image forming apparatuses well known in the art have used an endless belt for paper conveyance, the intermediate transfer of an image, and the like. In these types of image forming apparatuses, generally a belt cleaning device configured with a roller or brush is provided for removing toner, paper dust, or other foreign matter deposited on the belt (see Japanese Patent Application Publication No. 2001-109338, for example).

SUMMARY

When cleaning a belt with a cleaning member, such as the roller or brush described above, it is preferable that an appropriate pressing force acts between the cleaning member and the belt for achieving satisfactory cleaning. However, since both the cleaning member and belt can wear down quickly if a strong pressing force always acts between the cleaning member and the belt, it is preferable to have a structure capable of reducing the pressing force between the cleaning member and the belt when appropriate. Further, when cleaning a belt, it is sometimes preferable to use a strong force between the cleaning member and the belt and sometimes preferable to use a slightly weaker force. However, the conventional structure that applies only a constant force when the cleaning member contacts the belt cannot meet this need.

In view of the foregoing, it is an object of the invention to provide an image forming apparatus having a mechanism capable of suitably modifying the pressing force acting between the cleaning member and the belt according to the situation, while maintaining the cleaning member in a state of contact with the belt.

In order to attain the above and other objects, the invention provides an image forming apparatus. The image forming apparatus includes a belt, a cleaning member, a backup member, a pressing-force changing mechanism, and a control unit. The cleaning member is disposed in confrontation with the belt. The backup member is disposed to pinch the belt in cooperation with the cleaning member. The pressing-force changing mechanism is configured to change a pressing force acting between the cleaning member and the belt in a state in which the cleaning member is in contact with the belt. The control unit controls the pressing-force changing mechanism to change the pressing force.

According to another aspect, the invention also provides an image forming apparatus. The image forming apparatus includes a belt, a cleaning member, a backup member, a pressing-force changing mechanism, and a control unit. The cleaning member is disposed in confrontation with the belt. The backup member is disposed to pinch the belt in cooperation with the cleaning member. The pressing-force changing mechanism is configured to change a pressing force acting between the cleaning member and the belt in a state in which the cleaning member is in contact with the belt. The control unit controls the pressing-force changing mechanism to change the pressing force. The pressing-force changing mechanism includes a first pivoting member, a second pivoting member, a first urging member, a second urging member, and a cam member. The first pivoting member has a pivoting end and supports either one of the cleaning member and the backup member. The second pivoting member has a pivoting end and is capable of pivotally moving to contact the first pivoting member. The first urging member is provided at the first pivoting member to urge the pivoting end of the first pivoting member. The second urging member is provided at the second pivoting member to urge the pivoting end of the second pivoting member. The cam member has a large diameter part and a small diameter part. The cam member is configured to move the second pivoting member to separate from the first pivoting member, thereby prohibiting the second urging member from applying the urging force to the cleaning member when the large diameter part contacts the pivoting end of the second pivoting member. The cam member is configured to move the second pivoting member to contact the first pivoting member, thereby allowing the second urging member to apply the urging force to the cleaning member when the small diameter part confronts the pivoting end of the second pivoting member.

According to still another aspect, the invention also provides an image forming apparatus. The image forming apparatus includes a belt, a cleaning member, a backup member, a pressing-force changing mechanism, and a control unit. The cleaning member is disposed in confrontation with the belt. The backup member is disposed to pinch the belt in cooperation with the cleaning member. The pressing-force changing mechanism is configured to change a pressing force acting between the cleaning member and the belt in a state in which the cleaning member is in contact with the belt. The control unit controls the pressing-force changing mechanism to change the pressing force. The pressing-force changing mechanism includes a first pivoting member, a second pivoting member, a first urging member, a second urging member, a first cam member, and a second cam member. The first pivoting member has a pivoting end and supports either one of the cleaning member and the backup member. The second pivoting member has a pivoting end and is capable of pivotally moving about a same axis as the first pivoting member. The first urging member is provided at the first pivoting member to urge the pivoting end of the first pivoting member. The second urging member is provided at the second pivoting member to urge the pivoting end of the second pivoting member. The first cam member is rotatable about a cam shaft and is capable of contacting the first pivoting member. The first cam member has a large diameter part and a small diameter part. The first cam member is configured to prohibit the first urging member from applying the urging force to the cleaning member when the large diameter part contacts the pivoting end of the first pivoting member. The first cam member is configured to allow the first urging member to apply the urging force to the cleaning member when the small diameter part confronts the pivoting end of the first pivoting member. The second cam member is rotatable about the cam shaft and is capable of contacting the second pivoting member. The second cam member has a large diameter part and a small diameter part. The second cam member is configured to prohibit the second urging member from applying the urging force to the cleaning member when the large diameter part contacts the pivoting end of the second pivoting member. The second cam member is configured to allow the second urging member to apply the urging force to the cleaning member when the small diameter part confronts the pivoting end of the second pivoting member.

BRIEF DESCRIPTION OF THE DRAWINGS

Illustrative aspects in accordance with the invention will be described in detail with reference to the following figures wherein:

FIG. 18 is a top view of a metal shaft, a coil spring, a pivoting member, gears, and the like;

DETAILED DESCRIPTION

First Embodiment

An image forming apparatus according to a first embodiment of the invention will be described while referring to FIGS. 1 through 23C.

In the following description, the expressions "front", "rear", "upper", "lower", "right", and "left" are used to define the various parts when the image forming apparatus is disposed in an orientation in which it is intended to be used.

1. General Structure of a Laser Printer

Figure 1:
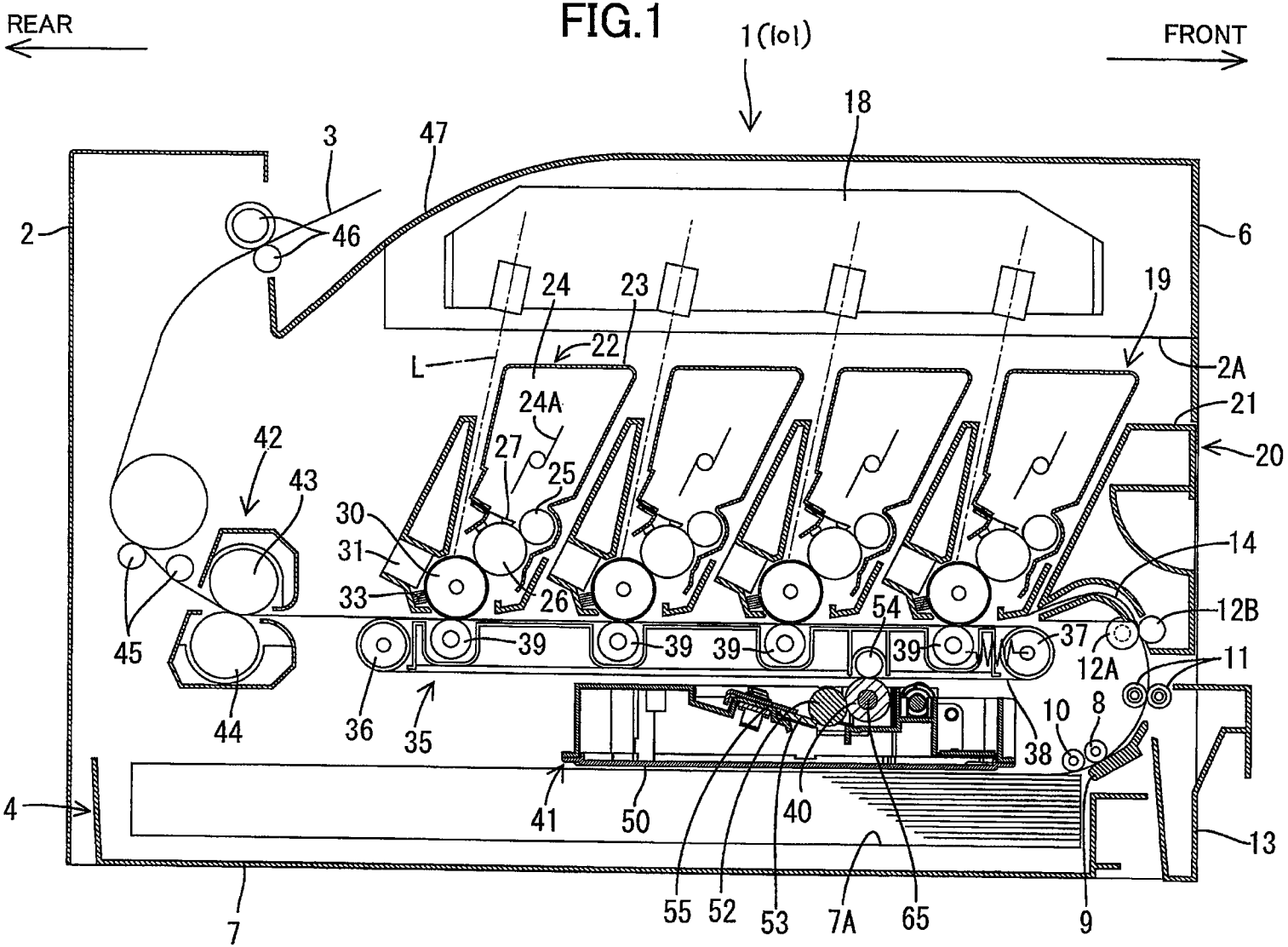
FIG. 1 is a side cross-sectional view showing the general structure of a laser printer serving as an image forming apparatus according to a first embodiment of the invention.

FIG. 1 is a side cross-sectional view showing the general structure of a laser printer 1 serving as the image forming apparatus of the embodiments. The laser printer 1 is a direct tandem type color laser printer having four photosensitive drums 30 corresponding to the colors black, cyan, magenta, and yellow, for example. The laser printer 1 includes a main casing 2 and, within the main casing 2, a paper supply unit 4 for supplying a paper 3, a scanning unit 18 for exposing the photosensitive drums 30, an image forming unit 20 for forming images on the paper 3 supplied from the paper supply unit 4, a paper conveying unit 35 for conveying the paper 3 to the image forming unit 20, and a cleaning unit 41 for cleaning a belt described later. In the embodiment, the paper conveying unit 35 is detachably mounted in the main casing 2 as a belt unit through an opening 2A described later. The cleaning unit 41 is also detachably mounted in the main casing 2 through the opening 2A. In the following description, the right side in FIG. 1 will be referred to as the front of the laser printer 1, and the left side as the rear.

<Paper Supply Unit>

The paper supply unit 4 includes a paper tray 7 detachably mounted in a lower section of the main casing 2; a separating roller 8 and separating pad 9 disposed above a front end of the paper tray 7; a pickup roller 10 disposed on the rear side of the feeding roller 8; a pair of paper dust rollers 11 disposed above and forward of the feeding roller 8; and a pair of registration rollers 12A and 12B disposed above the paper dust rollers 11.

The paper tray 7 has a shallow box shape open on the top for accommodating a stack of paper 3 to be used for image formation. A front wall 13 is provided on the front end of the paper tray 7 at a position below a front cover 6 on the front surface of the main casing 2. By pulling the front wall 13 in a forward direction, the user can pull the paper tray 7 horizontally from the front of the main casing 2. A paper-pressing plate 7A is disposed in the bottom of the paper tray 7 for supporting the stacked sheets of paper 3. The paper-pressing plate 7A is capable of rotating about the rear end thereof. A spring (not shown) is disposed beneath the front end of the paper-pressing plate 7A for urging the front end upward. Hence, the paper 3 stacked in the paper tray 7 is urged upward on the front end thereof.

Through the urging force of the paper-pressing plate 7A, the topmost sheet of paper 3 stacked in the paper tray 7 is pressed against the pickup roller 10. By rotating, the pickup roller 10 begins conveying this topmost sheet toward the feeding roller 8 and separating pad 9. As the feeding roller 8 rotates, the paper 3 becomes interposed between the feeding roller 8 and separating pad 9 and is separated and conveyed one sheet at a time. The feeding roller 8 conveys the sheet to the registration rollers 12A and 12B, during which time the paper dust rollers 11 remove paper dust from the paper 3.

The registration rollers 12A and 12B are configured of a drive roller 12A and a follow roller 12B. After correcting the registration of the paper 3, the registration rollers 12A and 12B convey the paper 3 along a paper conveying path 14 formed in a U-shape to invert the sheet of paper 3 and convey the sheet in a front-to-rear direction onto a paper conveying belt 38 of the paper conveying unit 35 described later.

<Scanning Unit>

The scanning unit 18 is disposed in an uppermost section of the main casing 2. The scanning unit 18 irradiates laser beams L for each color onto the surfaces of the corresponding photosensitive drums 30 in a high-speed scan based on predetermined image data. The four laser beams L corresponding to the four colors are irradiated obliquely downward and rearward from the bottom surface of the scanning unit 18 and follow optical paths formed parallel to each other and spaced at regular intervals in the front-to-rear direction.

<Image Forming Unit>

An accommodating section 19 is provided inside the main casing 2 below the scanning unit 18 in communication with the opening 2A. The image forming unit 20 is detachably accommodated in the accommodating section 19 and can be removed from the accommodating section 19 in a forward direction. The image forming unit 20 includes a frame 21 for holding four each of the photosensitive drums 30, Scorotron chargers 31, developer cartridges 22, and cleaning brushes 33. Since the structure of these components is identical for each of the colors black, cyan, magenta, and yellow, reference numerals have only been given for components of the color on the left in FIG. 1.

The developer cartridges 22 are detachably mounted in the frame 21 and correspond to the colors black, cyan, magenta, and yellow. Each developer cartridge 22 is configured of an accommodating case 23 having a box shape with an open bottom side. A toner-accommodating chamber 24 is formed in the top portion of the accommodating case 23 and is filled with a positive charging, nonmagnetic, single-component toner T (a polymer toner, or developer) for each respective color. An agitator 24A is provided inside the toner-accommodating chamber 24. The agitator 24A can be driven to rotate by a driving force inputted from a motor (not shown) so as to agitate the toner T in the toner-accommodating chamber 24. Below the toner-accommodating chamber 24, the accommodating case 23 also accommodates a supply roller 25, a developing roller 26, and a thickness-regulating blade 27.

The supply roller 25 is rotatably supported in the accommodating case 23 of the developer cartridge 22 and includes a metal roller shaft covered by a roller formed of an electrically conductive foam material. The supply roller 25 is driven to rotate by a driving force inputted from a motor (not shown).

The developing roller 26 is rotatably supported in the accommodating case 23 diagonally below and rearward of the supply roller 25 and contacts the supply roller 25 with pressure so that both are compressed. The developing roller 26 is placed in contact with the photosensitive drum 30 when the developer cartridge 22 is mounted in the frame 21. The developing roller 26 includes a metal roller shaft covered by a main roller body formed of an electrically conductive urethane rubber or silicon rubber containing fine carbon particles or the like. The surface of the main roller body is coated with a layer of urethane rubber or silicon rubber containing fluorine. A developing bias is applied to the developing roller 26 during a developing operation. The developing roller 26 is driven to rotate by a driving force inputted from a motor (not shown).

The thickness-regulating blade 27 includes a main blade member formed of a metal leaf spring member, and a pressing part provided on a distal end of the main blade member. The pressing part is formed of an insulating silicon rubber and has a semicircular cross section. The thickness-regulating blade 27 is supported on the accommodating case 23 above the developing roller 26 so that the pressing part is pressed against the developing roller 26 by the elastic force of the main blade member.

During a developing operation, toner T discharged from the toner-accommodating chamber 24 is supplied onto the developing roller 26 by the rotation of the supply roller 25. At this time, the toner T is positively tribocharged between the supply roller 25 and developing roller 26. As the developing roller 26 continues to rotate, the toner T supplied onto the developing roller 26 passes beneath the thickness-regulating blade 27, which further tribocharges the toner T and forms a thin layer of uniform thickness on the developing roller 26.

The photosensitive drum 30 is cylindrical in shape and is configured of a metal main drum body that is grounded and has a positive charging photosensitive layer formed of polycarbonate or the like on its outer surface. The photosensitive drum 30 is rotatably provided around a metal drum shaft penetrating the axial center of the main drum body and extending in the axial direction thereof. The drum shaft is supported on the frame 21. The photosensitive drum 30 is driven to rotate by a driving force inputted from a motor (not shown).

The charger 31 is disposed diagonally above and rearward of the photosensitive drum 30. The charger 31 confronts the photosensitive drum 30 but is separated a predetermined distance therefrom. The charger 31 is a positive-charging Scorotron type charger that produces a corona discharge from a charging wire formed of tungsten or the like in order to form a uniform charge of positive polarity over the surface of the photosensitive drum 30.

The cleaning brush 33 is disposed in opposition to the rear side of the photosensitive drum 30 and in contact with the same.

As the photosensitive drum 30 rotates, the charger 31 charges the surface of the photosensitive drum 30 with a uniform positive charge of +900 V, for example. Subsequently, a laser beam emitted from the scanning unit 18 is scanned at a high speed over the surface of the photosensitive drum 30, forming an electrostatic latent image corresponding to an image to be formed on the paper 3 by selectively changing the surface potential on portions of the surface to +100 V, for example.

Next, toner T positively charged to +450 V, for example, that is borne on the surface of the developing roller 26 comes into contact with the photosensitive drum 30 as the developing roller 26 rotates and is supplied to the electrostatic latent image formed on the surface of the photosensitive drum 30. In this way, the latent image on the photosensitive drum 30 is developed into a visible image according to a reverse developing process so that a toner image is borne on the surface of the photosensitive drum 30.

Subsequently, as the paper conveying belt 38 described later conveys a sheet of paper 3 through a transfer position between the photosensitive drum 30 and a transfer roller 39, the toner image borne on the surface of the photosensitive drum 30 is transferred onto the paper 3 by a negative transfer bias (−700 V, for example) applied to the transfer roller 39. After the toner image is transferred, the paper 3 is conveyed to a fixing unit 42 described later.

<Paper Conveying Unit>

The paper conveying unit 35 is disposed below the image forming unit 20 mounted in the accommodating section 19. The paper conveying unit 35 includes a pair of belt support rollers 36 and 37 arranged parallel to each other and separated in the front-to-rear direction, and the paper conveying belt 38 looped around the belt support rollers 36 and 37. The support roller 36 disposed on the rear side is driven to rotate by a motor so that the paper conveying belt 38 moves circularly. The support roller 36 disposed on the rear side (drive roller) includes a substantially cylindrical metal tube formed of aluminum or stainless steel, the surface of which is covered with a rubber layer or coated to ensure grip with the inner surface of the belt. The support roller 37 on the front side (tension roller) also includes a substantially cylindrical metal tube formed of aluminum or stainless steel, the surface of which has been plated to prevent surface wear caused by friction with the inner surface of the belt. The paper conveying belt 38 is an endless belt formed of a synthetic resin material such as polycarbonate and has a width dimension greater than or equal to the width dimension of the maximum paper size that can be printed on the laser printer 1 (an A4-size paper in the embodiment).

Four of the transfer rollers 39 are disposed at regular intervals in the front-to-rear direction inside the paper conveying belt 38 at positions confronting the respective photosensitive drums 30 in the image forming unit 20 described above so that the paper conveying belt 38 is interposed between the photosensitive drums 30 and the corresponding transfer rollers 39. Each of the transfer rollers 39 is configured of a metal roller shaft covered with an elastic member formed of an electrically conductive rubber material. A negative transfer bias is applied to the transfer roller 39 during a transfer operation. The cleaning unit 41 is disposed below the paper conveying belt 38. The cleaning unit 41 has a cleaning roller 40 for cleaning residual toner T and paper dust deposited on the paper conveying belt 38. When conveyed by the registration rollers 12A and 12B, the paper 3 passes through the paper conveying path 14 and contacts the top surface of the paper conveying belt 38 near the front end thereof. The paper 3 is electrostatically attracted to the top surface of the paper conveying belt 38 and is conveyed rearward as the paper conveying belt 38 moves circularly.

<Fixing Unit>

The fixing unit 42 is provided in the main casing 2 rearward of the paper conveying unit 35. The fixing unit 42 includes a heating roller 43 and a pressure roller 44 disposed in confrontation with each other for fixing a toner image transferred onto the paper 3 with heat. Conveying rollers 45 disposed diagonally above and rearward of the fixing unit 42 receive the paper 3 after the toner image has been fixed thereon. The conveying rollers 45 convey the paper 3 toward a pair of discharge rollers 46 disposed near the top of the main casing 2. A discharge tray 47 substantially horizontal on the front side and sloping downward toward the rear side is formed on the top surface of the main casing 2. After the conveying rollers 45 convey the paper 3 to the discharge rollers 46, the discharge rollers 46 discharge the paper 3 onto the discharge tray 47.

2. Electrical Structure of the Laser Printer

Figure 2:
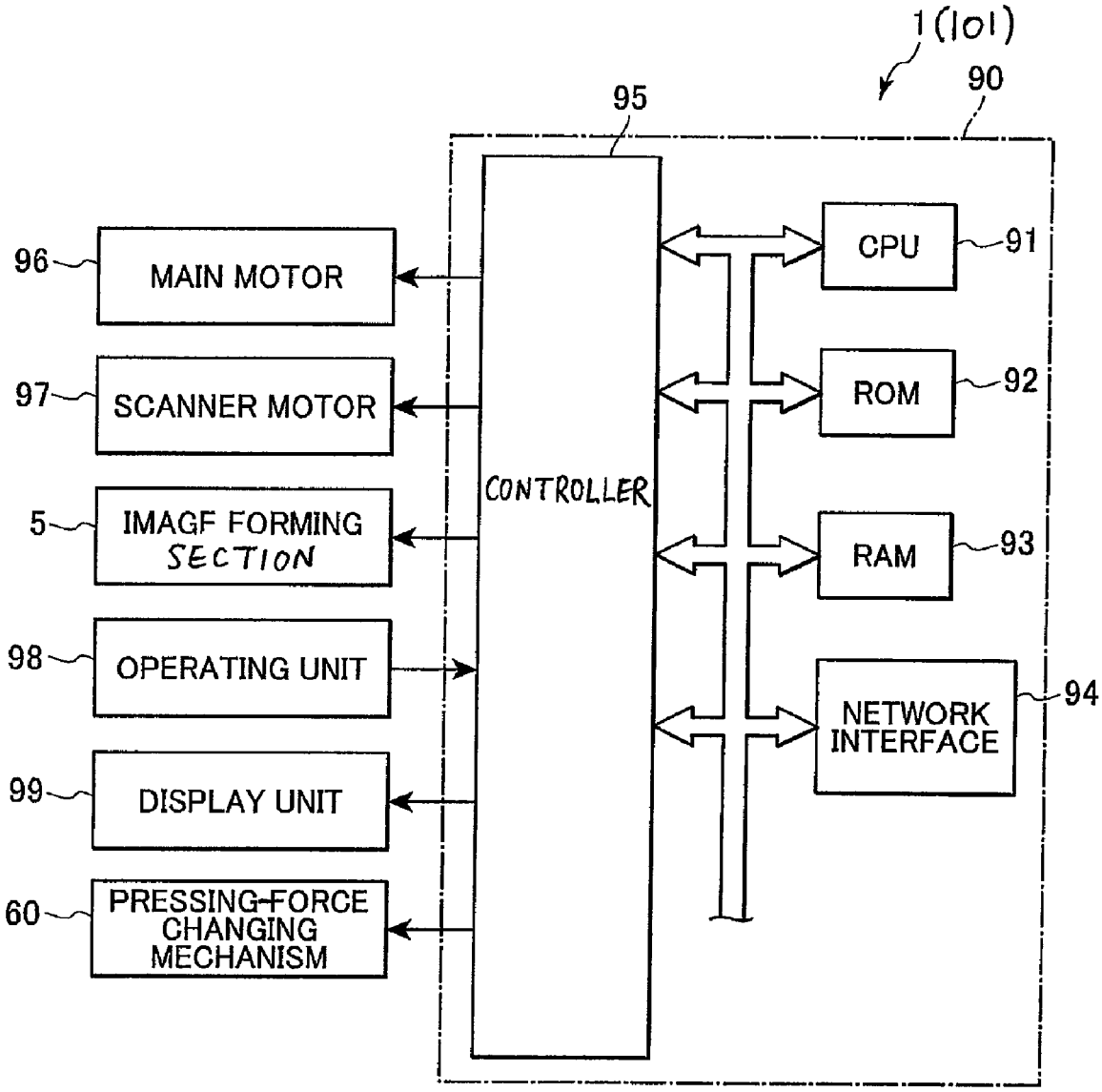
FIG. 2 is a block diagram showing the general electrical structure of the laser printer in FIG. 1.

Next, the electrical structure of the laser printer 1 will be described. FIG. 2 is a block diagram showing the general electrical structure of the laser printer 1. As shown in FIG. 2, the laser printer 1 is configured of a control device 90 for controlling various components in the laser printer 1. The control device 90 includes a CPU 91, a ROM 92, a RAM 93, and a controller 95 configured of an application specific integrate circuit (ASIC). A control system is configured by electrically connecting the controller 95 to a main motor 96, a scanner motor 97, an image forming section 5, an operating unit 98 configured of an input panel or the like, a display unit 99 configured of various lamps and the like, and a pressing-force changing mechanism 60 described later. The image forming section 5 includes the paper supply unit 4, scanning unit 18, image forming unit 20, paper conveying unit 35, and fixing unit 42 described above.

The ROM 92 and RAM 93 are connected to the CPU 91. The CPU 91 controls the various components of the laser printer 1 via the controller 95 according to procedures stored in the ROM 92, while storing results of processes performed according to these procedures in the RAM 93.

The main motor 96 functions to rotate the paper conveying belt 38 and the like described above. The scanner motor 97 functions to rotate a polygon mirror (not shown) provided in the scanning unit 18. The CPU 91 controls driving of the main motor 96 and scanner motor 97 based on a program stored in the ROM 92.

The controller 95 controls the image forming section 5 based on commands received from the CPU 91. More specifically, the controller 95 controls components constituting the scanning unit 18 to expose the surfaces of the photosensitive drums 30 and controls the application of a transfer bias for transferring toner onto the paper 3.

The control device 90 is also provided with a network interface 94 for connecting the laser printer 1 to a personal computer or other external device.

The CPU 91 serves as a control unit that controls the pressing-force changing mechanism 60.

3. Basic Structure of the Cleaning Unit

Figure 3:
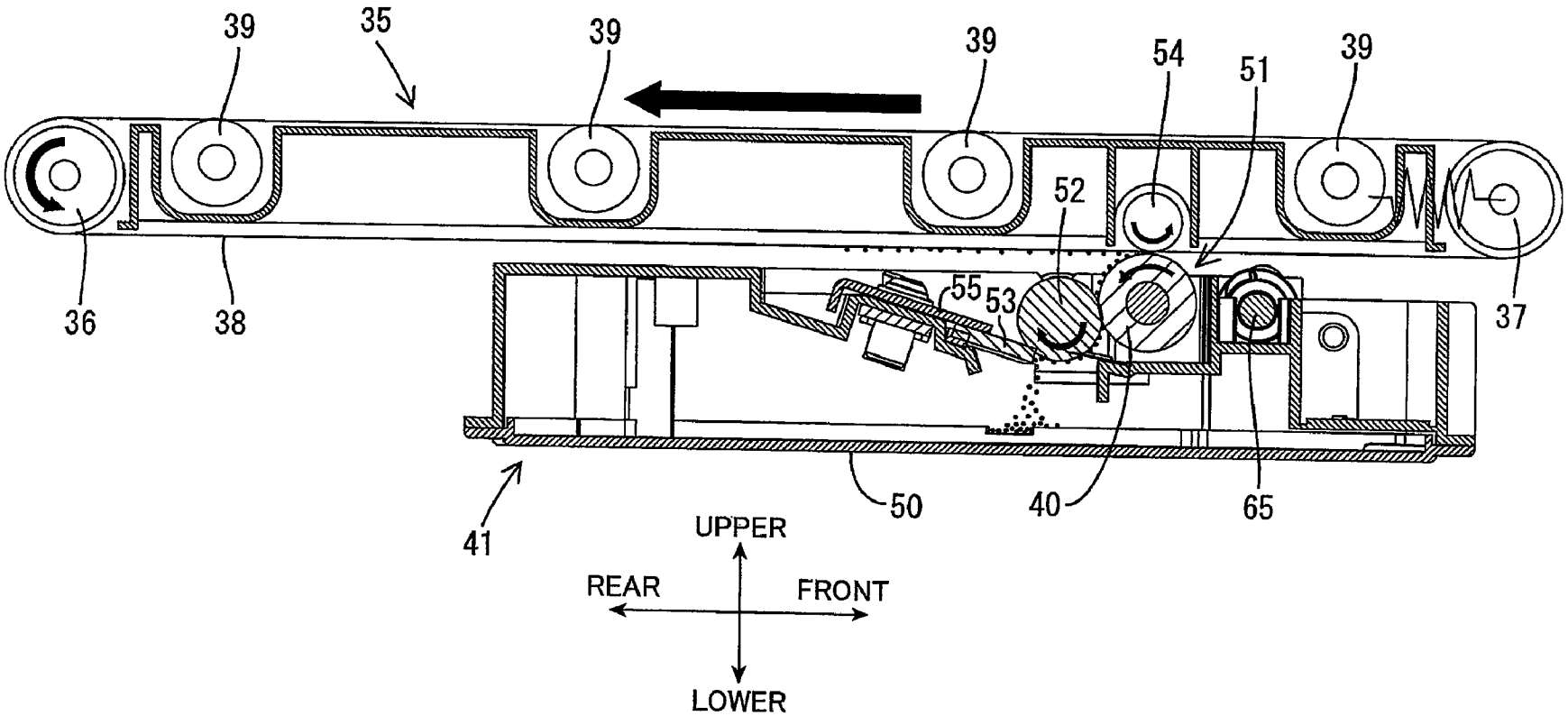
FIG. 3 is an enlarged side cross-sectional view of a paper conveying unit and a cleaning unit of the laser printer in FIG. 1.

FIG. 3 is an enlarged side cross-sectional view of the paper conveying unit 35 and the cleaning unit 41.

The cleaning unit 41 includes an elongated box-shaped case 50 extending in the front-to-rear direction that is detachably provided in the main casing 2 below the transfer belt 38. The case 50 has an integrally formed frame. Pairs of engaging protrusions 70 and 71 (see FIG. 4) are provided on the frame for engaging with a frame part in a main body of the laser printer 1. Note that the main body of the laser printer 1 is part of the laser printer 1 excluding the cleaning unit 41.

The case 50 has an opening 51 formed in the top surface near the front side thereof. The cleaning roller 40 is rotatably provided inside the opening 51. The cleaning roller 40 is one example of a cleaning member with an outer surface that contacts the paper conveying belt 38 for cleaning the same. The cleaning roller 40 in the embodiment is a silicon foam roller configured of a metal roller shaft that is covered with a roller body formed of an electrically conductive foam material. Deposited matter on the paper conveying belt 38 removed by the cleaning roller 40 is collected in the case 50. The case 50 is integrally formed with a frame part of the cleaning unit 41.

A metal roller 52 formed of a metal or other hard material is rotatably provided diagonally below and rearward of the cleaning roller 40 and contacts the cleaning roller 40 with pressure.

A scraping blade 53 is disposed below the metal roller 52. The scraping blade 53 is configured of an elastic main blade member having a rear end gripped by and fixed in a metal holder 55, and a free front end that contacts the lower surface of the metal roller 52 with pressure through the elastic force of the main blade member. The scraping blade 53 is formed of a rubber material and contacts the metal roller 52 along substantially the entire length thereof with a uniform pressure. Accordingly, the rear end of the scraping blade 53 must be held with a sufficiently strong force. Hence, the holder 55 is formed of metal having a relatively high strength. A backup roller 54 formed of a metal or other conductive material is rotatably provided above the cleaning roller 40 so that the transfer belt 38 is pinched between the backup roller 54 and the cleaning roller 40 from above and below, respectively. The backup roller 54 is one example of a backup member that contacts the belt with the outer surface thereof and rotates along with the movement of the belt.

The cleaning unit 41 executes a cleaning operation after an image has been formed on the paper 3 and the paper 3 has left the fixing unit 42 and until the discharge rollers 46 discharge the paper 3, for example. As shown in FIG. 3, during a cleaning operation, a motor (not shown) provides a driving force for driving the cleaning roller 40 to rotate counterclockwise in the drawing and for driving the metal roller 52 to rotate clockwise. Hence, the peripheral surface of the cleaning roller 40 moves opposite the outer surface of the transfer belt 38 at the contact surface therebetween. The backup roller 54 rotates counterclockwise in the drawing along with the circular movement of the transfer belt 38.

Further, the roller shaft of the backup roller 54 is grounded and, during a cleaning operation, a negative bias of −3 kV, for example, is applied to the cleaning roller 40, while an even lower negative bias of −3.5 kV, for example, is applied to the metal roller 52. Accordingly, residual toner T and paper dust deposited on the transfer belt 38 migrates to the cleaning roller 40 near the position between the cleaning roller 40 and the backup roller 54 due to the bias attraction and the contact force of the cleaning roller 40. The residual toner T and the like borne on the cleaning roller 40 is subsequently transferred to the hard metal roller 52 by the bias attraction, scraped off of the metal roller 52 by the scraping blade 53, and ultimately collected in the case 50.

4. Pressing-Force Changing Mechanism

Figure 4:
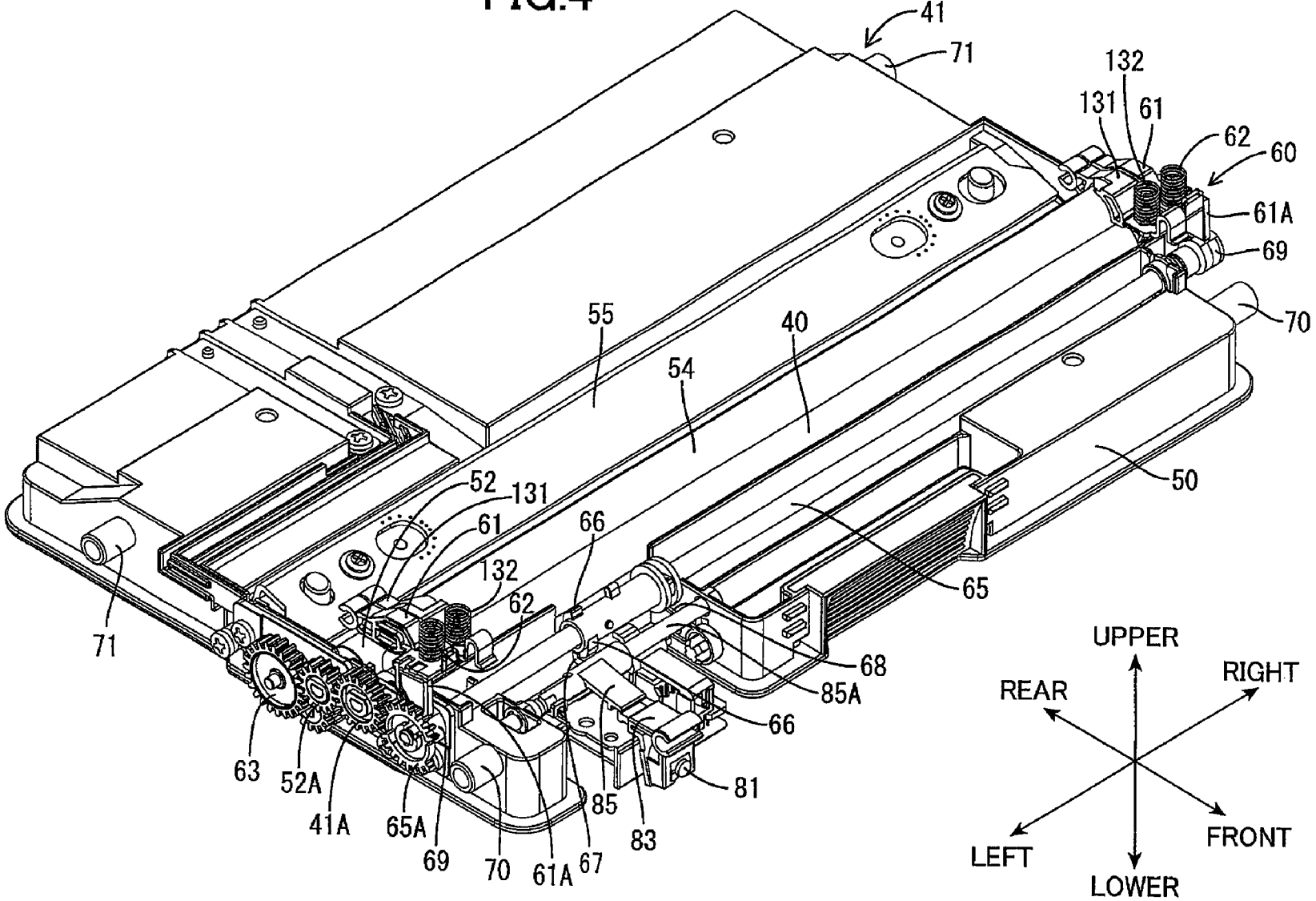
FIG. 4 is a perspective view of the cleaning unit and a pressing-force changing mechanism.
Figure 5:
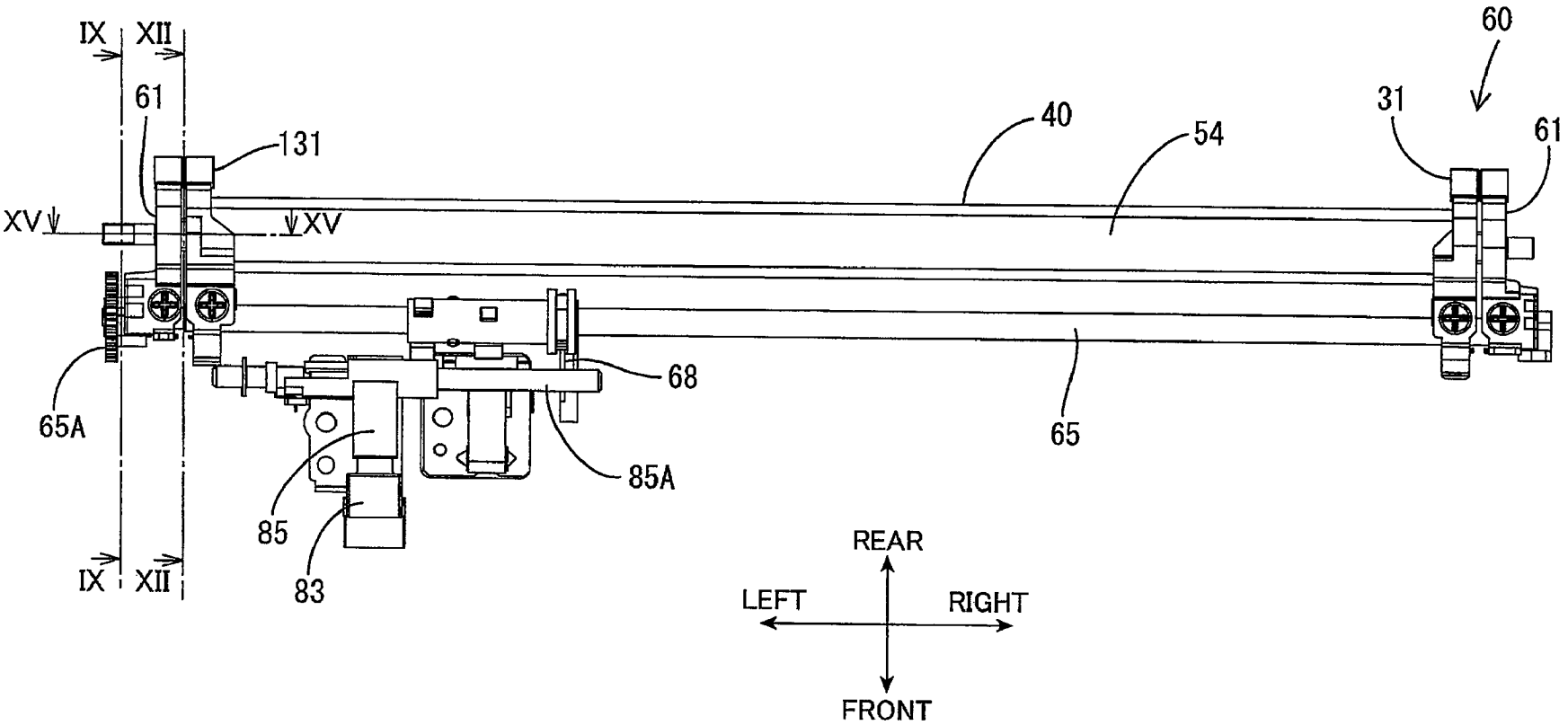
FIG. 5 is a top view showing relevant parts of the pressing-force changing mechanism.
Figure 6:
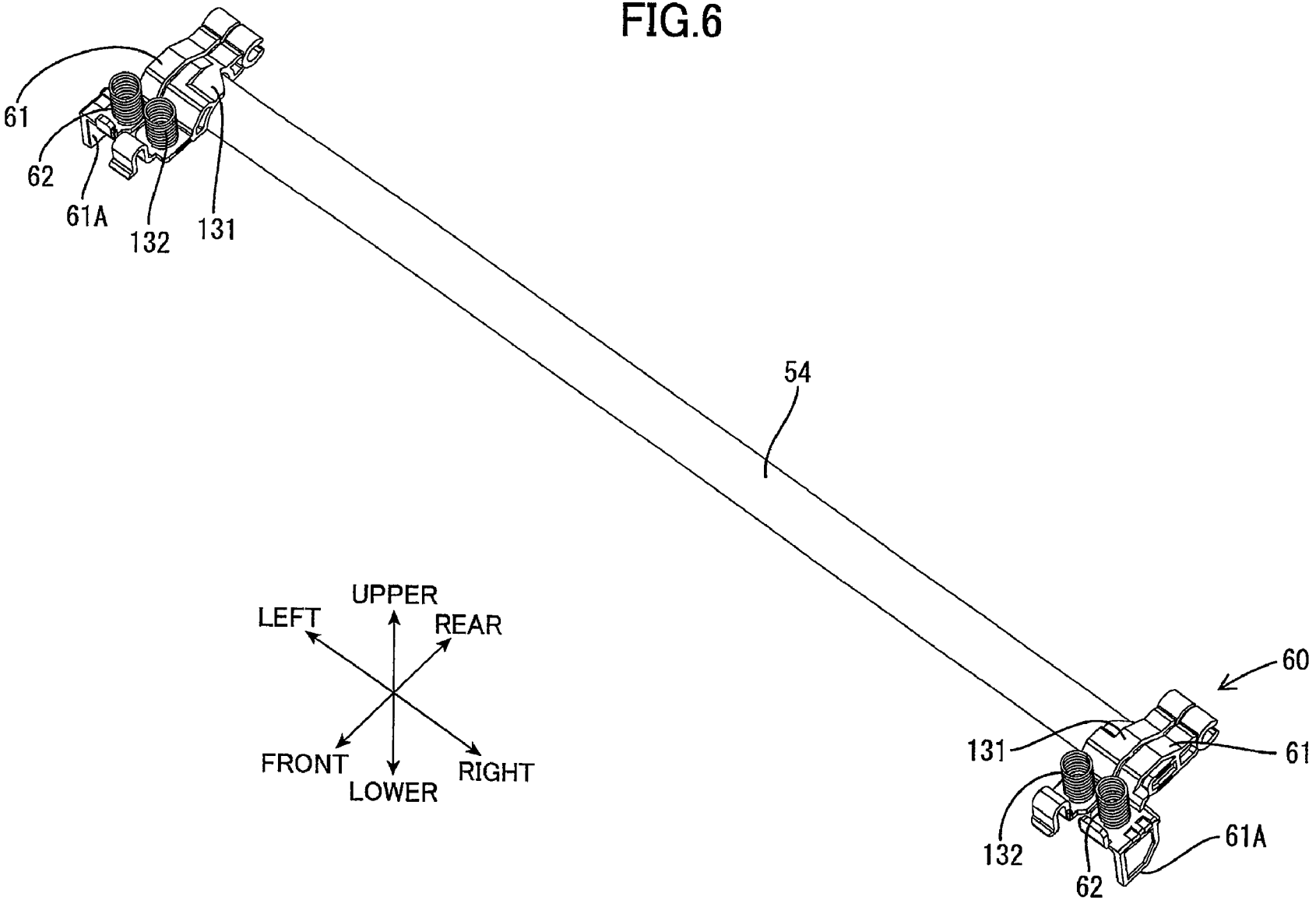
FIG. 6 is a perspective view showing relevant parts of the pressing-force changing mechanism from diagonally above the mechanism.
Figure 7:
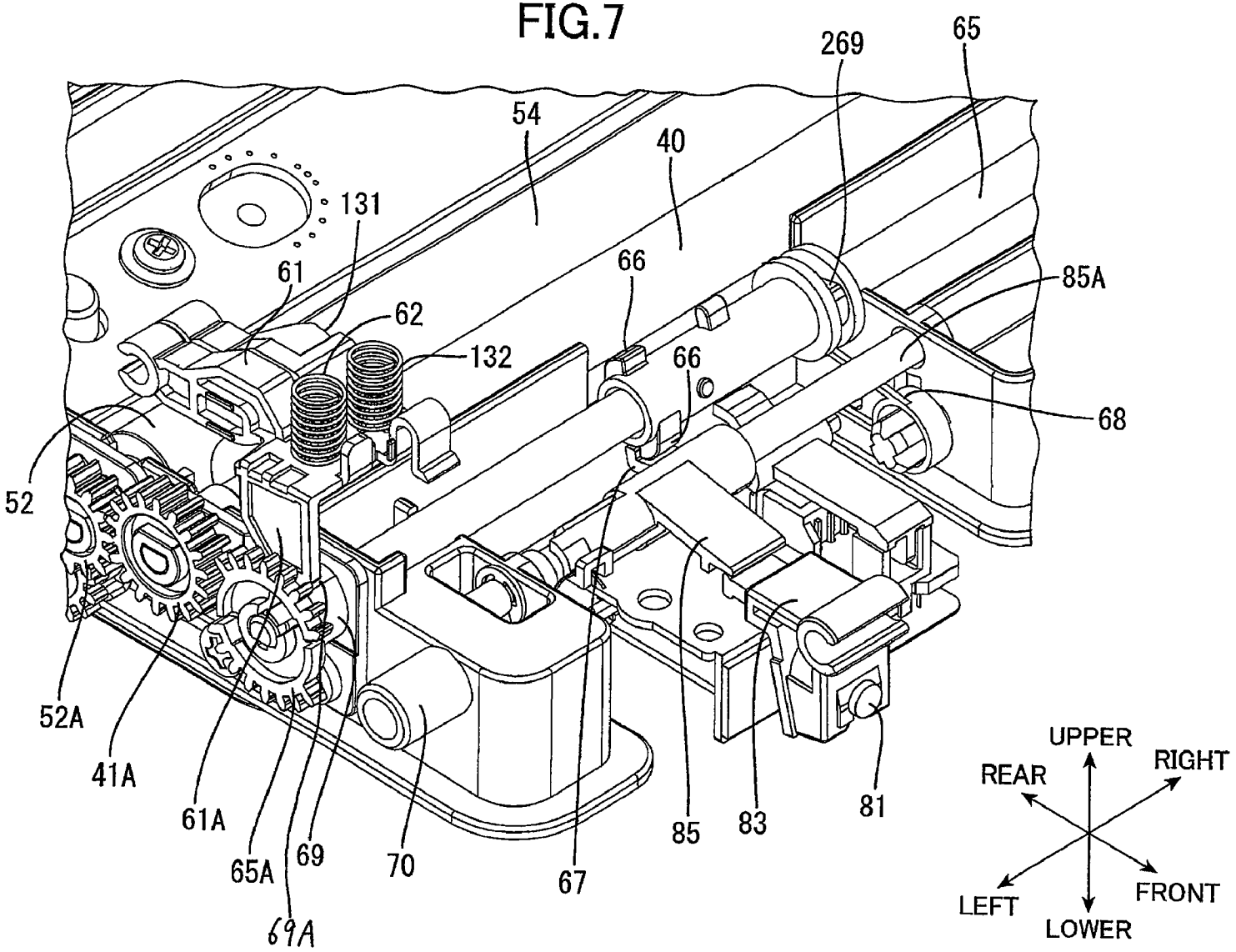
FIG. 7 is an enlarged perspective view showing part of the pressing-force changing mechanism in a second mode.

FIG. 4 is a perspective view of the cleaning unit 41 and the pressing-force changing mechanism 60, wherein the lower right side of the drawing is the front of the laser printer 1 (the opening 2A side of the main casing 2). FIG. 5 is a top view showing relevant parts of the pressing-force changing mechanism 60. FIG. 6 is a perspective view of the structure in FIG. 4 from a different angle showing the backup roller 54 and the support structure therefor. FIG. 7 is an enlarged perspective view showing part of the pressing-force changing mechanism 60 when the pressing-force changing mechanism 60 is set to a second mode.

In the laser printer 1 according to the present embodiment, the pressing-force changing mechanism 60 is provided for changing the force with which the backup roller 54 presses against the cleaning roller 40 during the cleaning operation described above and non-cleaning operations at all other times. Specifically, during image formation (during a non-cleaning operation), such as from the moment an image forming command is issued, while the paper 3 is conveyed from the paper tray 7 onto the paper conveying belt 38 and a toner image is transferred onto the paper 3, and until the toner image is fixed in the fixing unit 42, the pressing-force changing mechanism 60 sets the pressure applied to the paper conveying belt 38 to a weaker load than that applied in a first mode described later. However, during a cleaning operation, the pressing-force changing mechanism 60 sets the pressure applied by the backup roller 54 against the paper conveying belt 38 to a stronger force.

Figure 15:
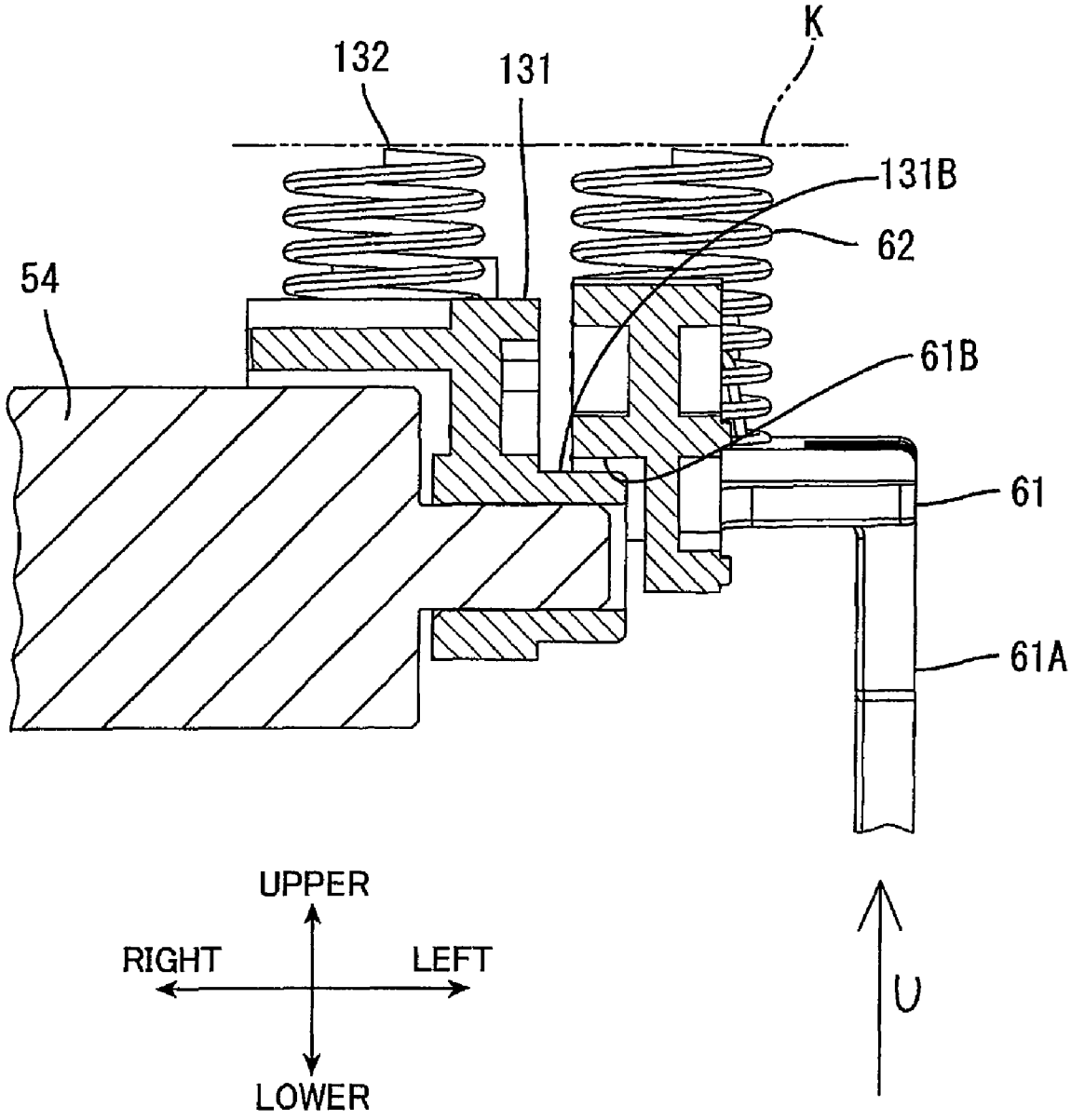
FIG. 15 is a cross-sectional view of the pressing-force changing mechanism in the second mode along a line XV-XV shown in FIG. 5.
Figure 16:
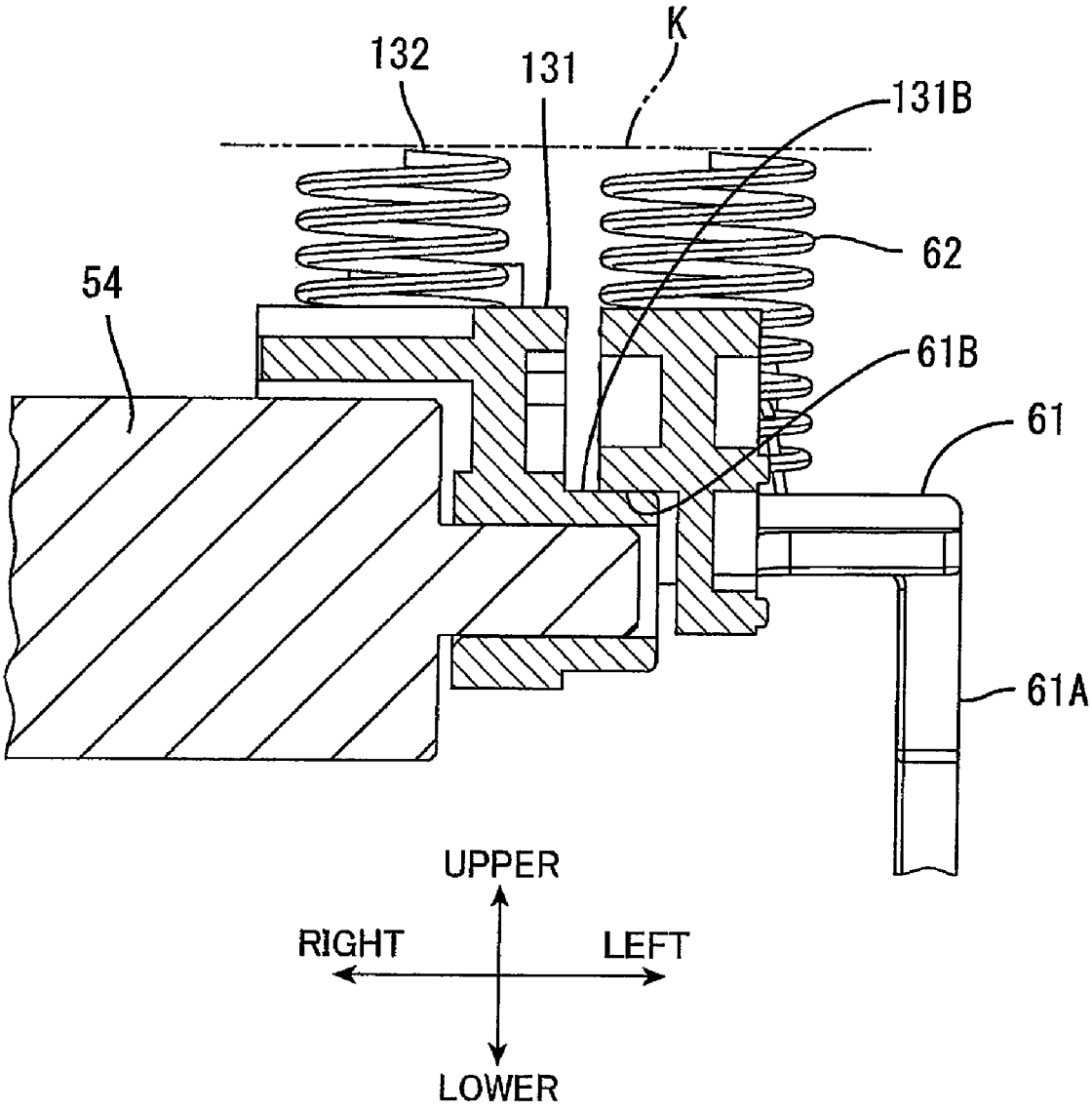
FIG. 16 is a cross-sectional view of the pressing-force changing mechanism in the first mode along the line XV-XV shown in FIG. 5.

As shown in FIGS. 4 and 6, a pair of pivoting support arms 131 (first pivoting members) is disposed on both ends (left and right ends) of the backup roller 54 for rotatably supporting the same (see also FIG. 16). A rear end of each pivoting support arm 131 is pivotally supported on a support shaft (not shown in FIG. 4, but indicated by a dotted line J in FIG. 12) provided on the main casing 2 side parallel to the backup roller 54 so that a front end of the pivoting support arm 131 can move up and down. First spring members 132 press the pivoting ends (front ends) of the pivoting support arms 131 downward toward the cleaning unit 41. The first spring members 132 constitute a first spring set and are configured to urge both ends of the backup roller 54 indirectly via the pivoting support arms 131. The upper ends of the first spring members 132 are supported on a frame provided in the main body of the laser printer 1 (the outer surface of the frame conceptually illustrated by a dotted line K in FIGS. 12, 15, and 16).

Figure 9:
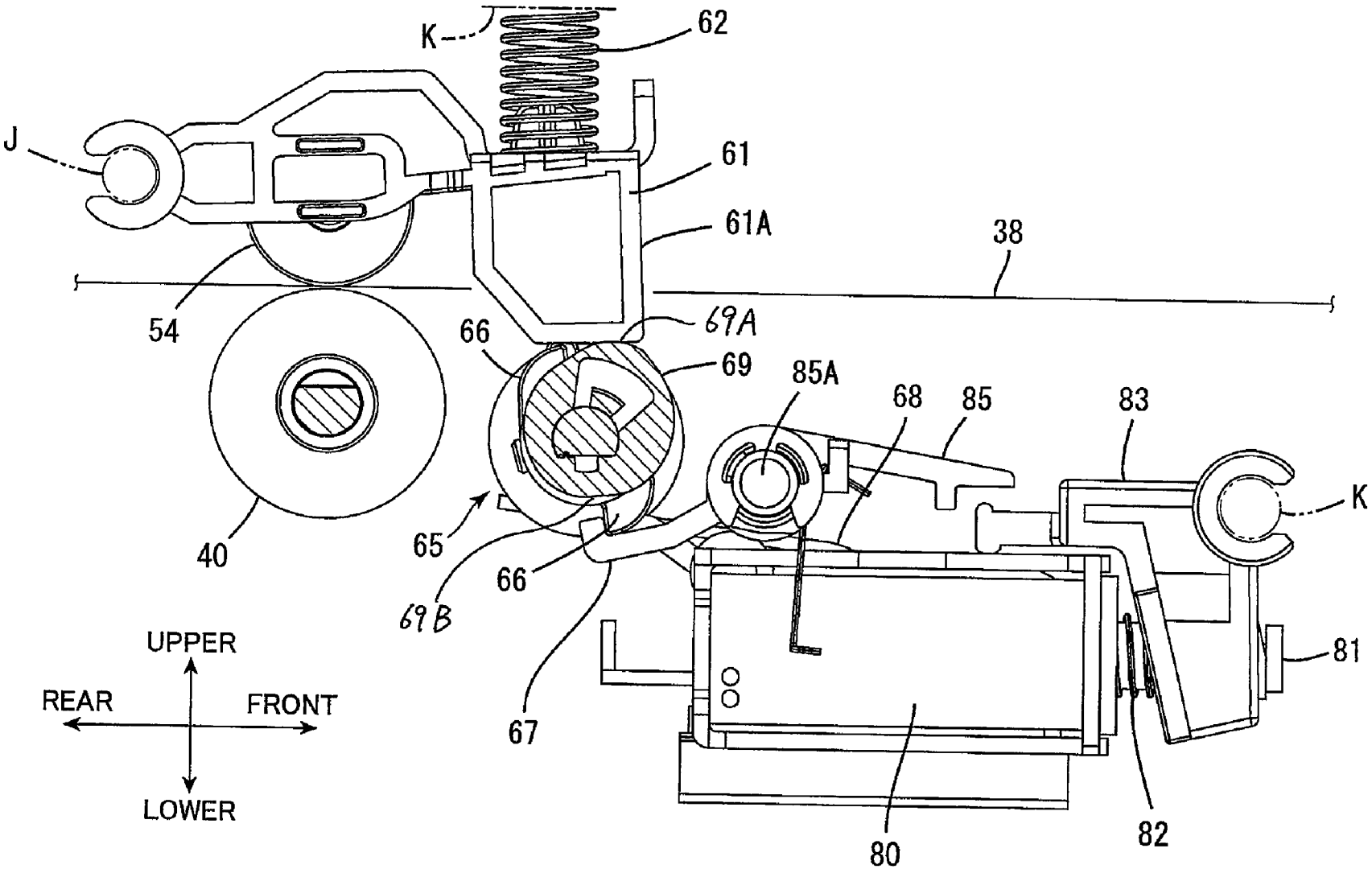
FIG. 9 is a side cross-sectional view of the pressing-force changing mechanism set in the second mode along a line IX-IX shown in FIG. 5.
Figure 10:
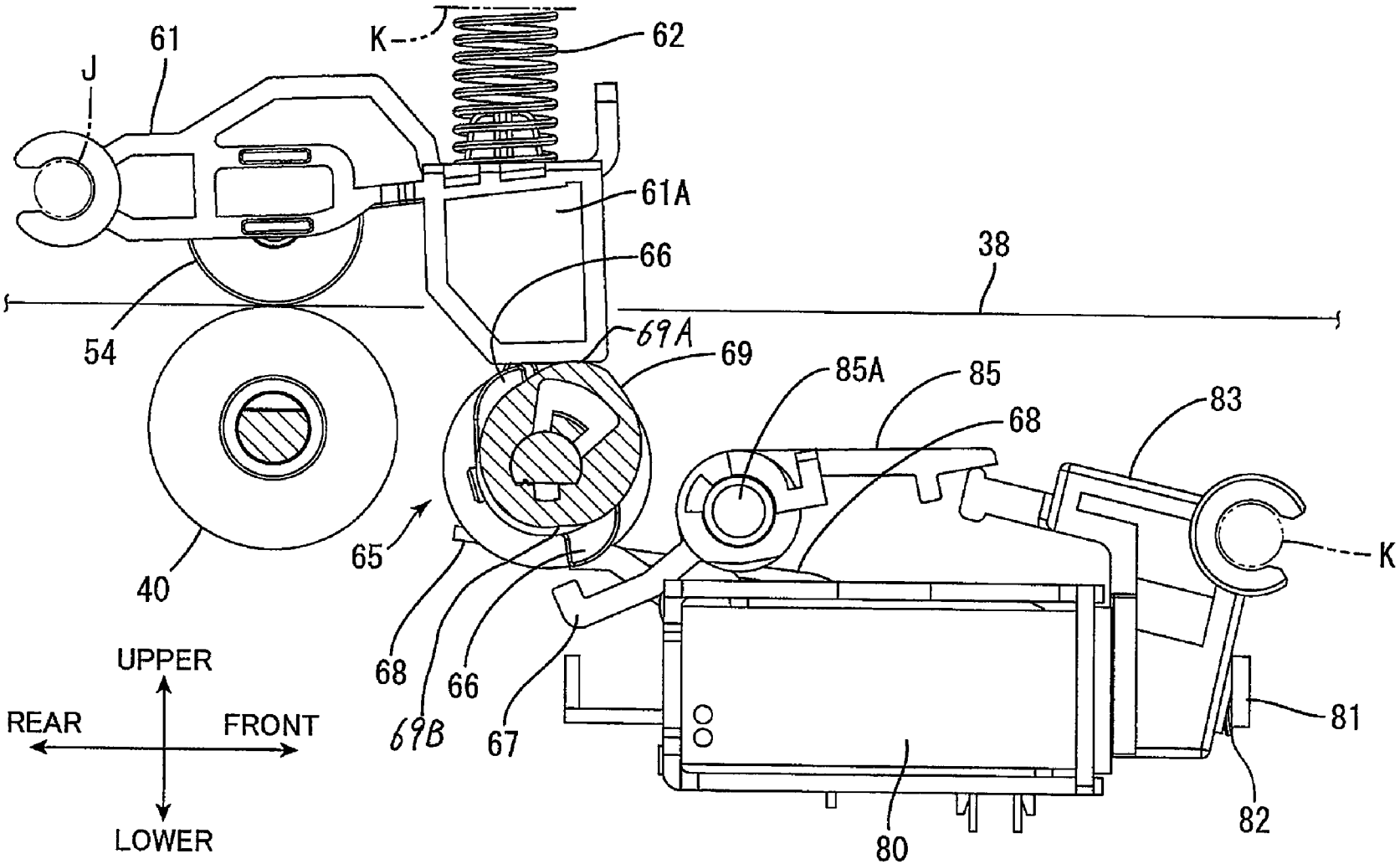
FIG. 10 is a side cross-sectional view of the pressing-force changing mechanism shown in FIG. 9 immediately after driving a solenoid.
Figure 11:
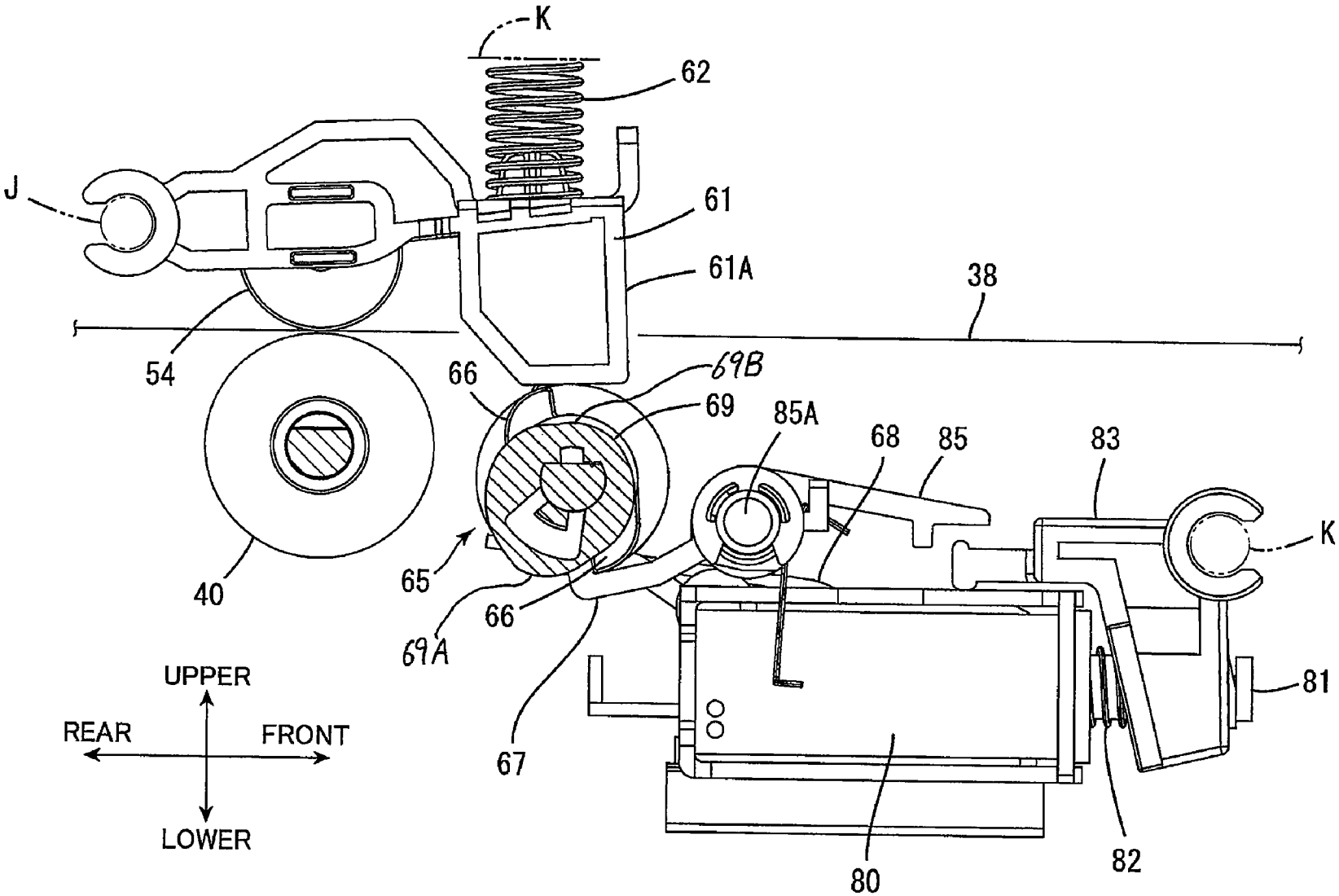
FIG. 11 is a side cross-sectional view of the pressing-force changing mechanism switched from the state shown in FIG. 9 to the first mode.
Figure 12:
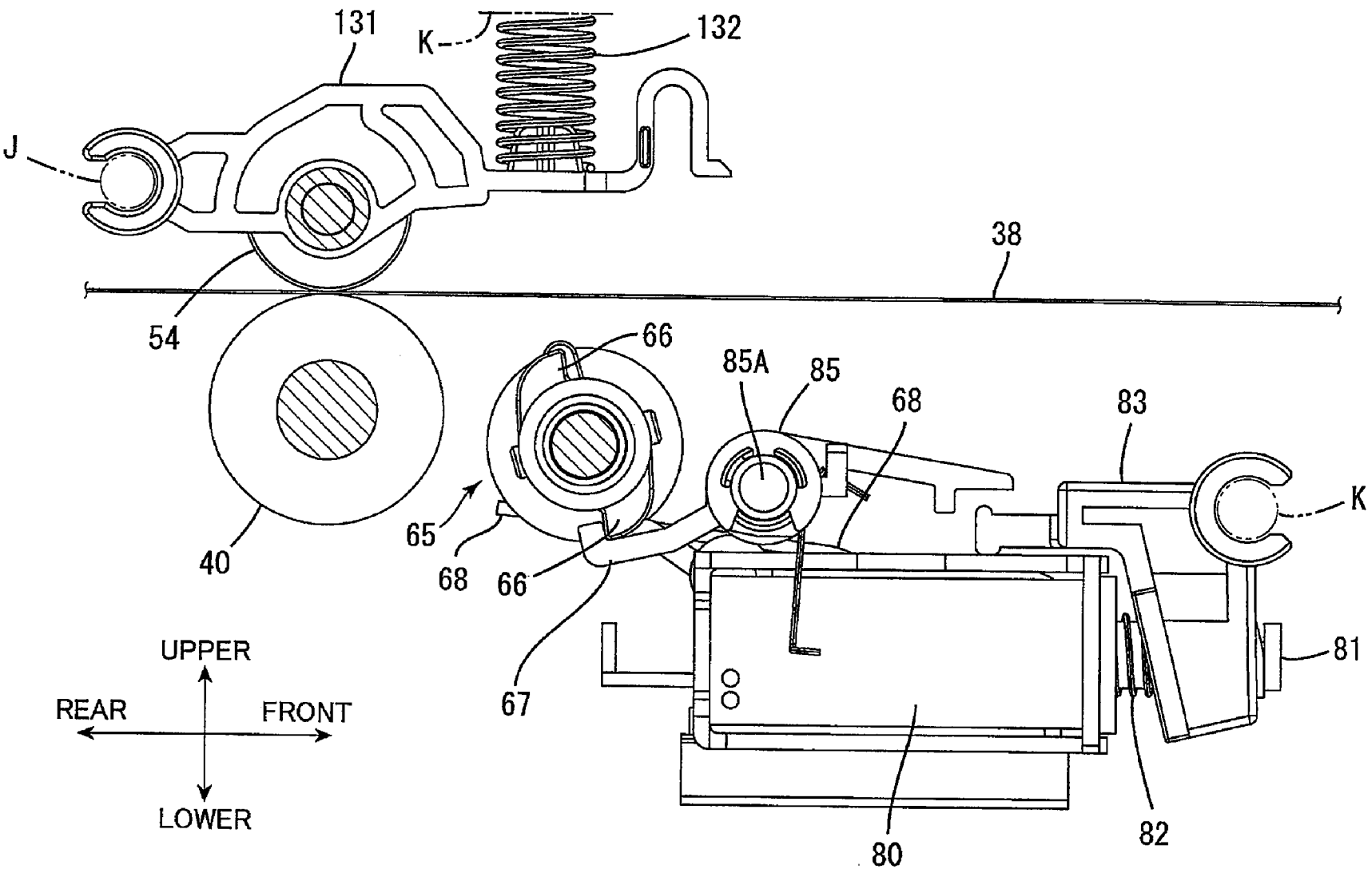
FIG. 12 is a side cross-sectional view of the pressing-force changing mechanism along a line XII-XII shown in FIG. 5 showing command states of the first and second modes.

A pair of second spring members 62 constituting a second spring set can compress independently of the first spring set. The second spring set is configured to urge a pair of pivoting arms 61 (second pivoting members) that can pivot adjacent to the pivoting support arms 131. As shown in FIGS. 9 through 11, the pivoting arms 61 are supported on the above-mentioned support shaft (indicated by the dotted line J in FIGS. 9 through 11) supporting the pivoting support arms 131 so as to pivot about the same axis as the pivoting support arms 131. The pivoting arms 61 urge the pivoting support arms 131 according to the operating state of the pressing-force changing mechanism described later. With this construction, the second spring set configured of the second spring members 62 can urge both ends of the backup roller 54 via the pivoting arms 61 and pivoting support arms 131. The upper ends of the second spring members 62 are supported on the frame provided in the main body of the laser printer 1 (the outer surface of the frame conceptually illustrated by the dotted line K in FIGS. 9-11, 15, and 16).

The backup roller 54, pivoting support arms 131, pivoting arms 61, first spring members 132 (first urging members), and second spring members 62 (second urging members) rest on the paper conveying unit 35. In FIG. 4, the paper conveying belt 38 should be shown between the backup roller 54 and the cleaning roller 40 in reality, but has been omitted from the drawing for the sake of description.

As shown in FIGS. 4 and 5, both ends of the roller shaft in the cleaning roller 40 protrude out from the cleaning roller 40 and are received in left and right walls of the case 50. A rotating gear 41A is integrally provided on one end of the roller shaft (the left end in an example of FIG. 4). Similarly, both ends of the roller shaft in the metal roller 52 protrude out from the metal roller 52 and are received in the left and right walls of the case 50. A rotating gear 52A is integrally provided on one end of the roller shaft (the left end in the example of FIG. 4) and engages with the rotating gear 41A (the rotating gear 41A and rotating gear 52A have been omitted from FIG. 5). An input gear 63 is provided on the rear of the rotating gear 52A. The input gear 63 engages both with the rotating gear 52A and with an output gear (not shown) provided on the main casing of the laser printer 1 when the cleaning unit 41 is mounted in the main casing 2. The output gear is disposed diagonally below and rearward of the input gear 63 and is driven to rotate by a driving force inputted from a motor (not shown) provided in the main casing 2. This motor rotates based on image forming commands, for example. The drive force of the motor is transmitted to the rotating gear 41A and the rotating gear 52A via the output gear and the input gear 63 to rotate the cleaning roller 40 and metal roller 52.

As shown in FIGS. 4 and 5, a metal shaft 65 is disposed in front of and parallel to the cleaning roller 40, with both ends protruding through the left and right walls of the case 50. A notched gear 65A having a pair of notched portions positioned symmetrically about the center thereof is integrally provided on one end of the metal shaft 65 (the left end in the example of FIG. 4). A pair of protruding parts 66 is disposed on the metal shaft 65 at symmetrical positions about the axial center of the metal shaft 65. An engaging arm 67 (see FIGS. 7-11) is provided on the metal shaft 65 for engaging with one of the protruding parts 66 when the notched gear 65A is rotated so that a notched part in the notched gear 65A confronts the rotating gear 41A.

As shown in FIGS. 9 through 11, the engaging arm 67 is configured to operate in association with a solenoid 80. The solenoid 80 is turned on when a command signal for an image forming operation or a command for the cleaning operation described above is received. By turning on, the solenoid 80 disengages the engaging arm 67 from the protruding parts 66. When the engaging arm 67 is disengaged from the protruding parts 66, a coil spring 68 forcibly rotates the metal shaft 65 until the toothed region of the notched gear 65A is engaged with the rotating gear 41A. The notched gear 65A is not interlocked with the rotating gear 41A when the engaging arm 67 is engaged with the protruding parts 66, but becomes interlocked with the rotating gear 41A when the engaging arm 67 is disengaged from the protruding parts 66 and the metal shaft 65 is rotated by the coil spring 68. As shown in FIGS. 18, 19A, 20A, 21A, 22A, and 23A, a cam 269 is provided on the metal shaft 65. The cam 269 has a substantially elliptic shape which is point-symmetric about the rotational center of the metal shaft 65. The cam 269 has straight parts 269A and round parts 269B, where corner parts 269C are formed between the straight parts 269A and round parts 269B. Note that a single-dot chain line X (FIGS. 18 through 23C) passes the rotational center of the metal shaft 65. The operations of these parts will be described later.

As shown in FIG. 4, a pair of cam members 69 is integrally provided on both ends of the metal shaft 65 (the cam members 69 on the left end being positioned inside the notched gear 65A). Each cam member 69 has a large diameter part 69A and a small diameter part 69B (FIGS. 9 through 11). The cam members 69 are provided corresponding to the second spring members 62 and are configured to drive the second spring members 62 through their own displacement. The metal shaft 65 and the driving mechanism for the metal shaft 65 serves as a cam member driving mechanism for driving the cam members 69 to rotate. In the present embodiment, the cam member driving mechanism is configured of the metal shaft 65, the motor (not shown), the input gear 63, the rotating gear 52A, the rotating gear 41A, and the notched gear 65A, but it should be apparent that a structure different from the structure in the present embodiment may be employed as the cam member driving mechanism, provided that the mechanism can set the cam members 69 in a predetermined first rotational position, and a second rotational position rotated a predetermined angle from the first rotational position.

As shown in FIGS. 4 and 9 through 11, when the cleaning unit 41 is mounted in the main casing 2 with the paper conveying unit 35 mounted above the cleaning unit 41, pivoting ends 61A of the pivoting arms 61 rest on the upper peripheral surfaces of the cam members 69. The pivoting ends 61A are displaced in response to displacement of the cam members 69, causing the pivoting arms 61 to pivot.

5. Operations of the Pressing-Force Changing Mechanism

Next, the operations of the pressing-force changing mechanism 60 will be described with reference to FIGS. 4, 5, and 7 through 11.

As described above, the cleaning roller 40 is disposed in confrontation with the paper conveying belt 38. The paper conveying belt 38 indirectly carries a developer image via paper. The cleaning roller 40 is configured to pinch the paper conveying belt 38 with the backup roller 54. The pressing-force changing mechanism 60 is provided for changing the force with which the cleaning roller 40 presses against the paper conveying belt 38, while maintaining the cleaning roller 40 in contact with the paper conveying belt 38.

The CPU 91 controls the operations of the pressing-force changing mechanism 60 with a mode setting function. The pressing-force changing mechanism 60 is configured to set or change a pressing mode with which the cleaning roller 40 presses against the paper conveying belt 38 between a first mode for pressing the cleaning roller 40 against the paper conveying belt 38 at a predetermined pressure, and a second mode for pressing the cleaning roller 40 against the paper conveying belt 38 at a pressure smaller than the first mode. While timing (time period) in which the mode is set to the first mode and the second mode can be varied, one method is to set the pressing mode to the first mode for a predetermined time period after an image has been formed on each sheet of paper and to set the pressing mode to the second mode at all other times. The CPU 91 controls the pressing-force changing mechanism 60 according to the control system shown in FIG. 2 by outputting signals to the pressing-force changing mechanism 60 corresponding to the mode to be set.

As shown in FIGS. 3 and 4, the cleaning roller 40 in the present embodiment is held at a fixed support position, while the pressing-force changing mechanism 60 functions as a load switching mechanism for switching the load that the backup roller 54 applies to the cleaning roller 40. As shown in FIGS. 4 and 6, the pressing-force changing mechanism 60 has the first spring members 132 and second spring members 62 for urging the backup roller 54 and switches the combination of spring members that are used to urge the backup roller 54.

Of the first spring members 132 and second spring members 62, the first spring members 132 constitute a first spring set capable of indirectly urging both ends of the backup roller 54, while the second spring members 62 constitute a second spring set capable of indirectly urging both ends of the backup roller 54 and capable of being driven independently of the first spring set. Based on commands from the CPU 91, the pressing-force changing mechanism 60 switches between a state in which both the first and second spring sets are applied to the backup roller 54 and a state in which only one of the spring sets is applied to the backup roller 54.

Figure 18:
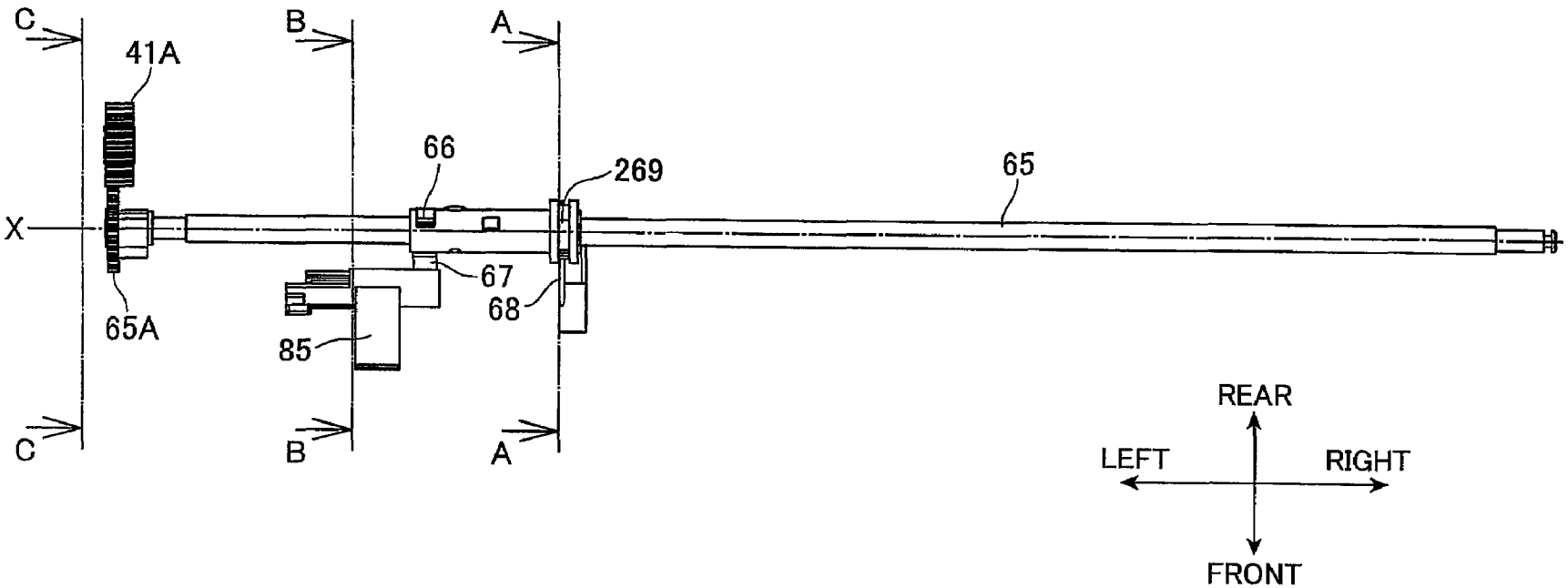

The pressing-force changing mechanism 60 that employs this control structure will be described in detail from the state shown in FIGS. 7 and 9 to the state shown in FIGS. 8 and 11, with also referring to FIGS. 18 through 23C. FIG. 18 is a top view of the metal shaft 65, the coil spring 68, the engaging arm 67, the rotating gear 41A, the notched gear 65A, and the like. FIGS. 19A, 20A, 21A, 22A, and 23A are enlarged views of a cam 269 and the coil spring 68 as viewed from a line A-A in FIG. 18. FIGS. 19B, 20B, 21B, 22B, and 23B are enlarged views of the protruding parts 66 and the engaging arm 67 as viewed from a line B-B in FIG. 18. FIGS. 19C, 20C, 21C, 22C, and 23C are enlarged views of the rotating gear 41A and the notched gear 65A as viewed from a line C-C in FIG. 18.

Figure 19A:
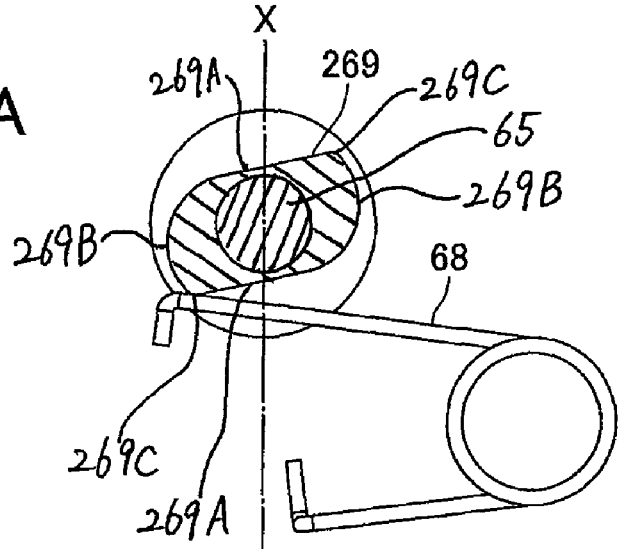
FIG. 19A is an enlarged view of a cam and the coil spring in the second mode, as viewed from a line A-A in FIG. 18.
Figure 19B:
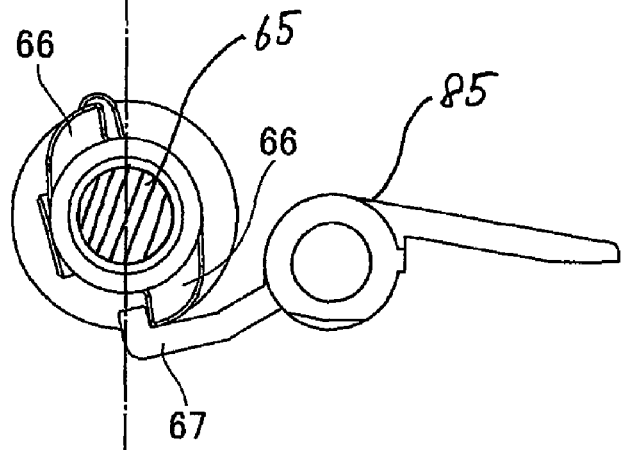
FIG. 19B is an enlarged view of a pair of protruding parts and an engaging arm in the second mode, as viewed from a line B-B in FIG. 18.
Figure 19C:
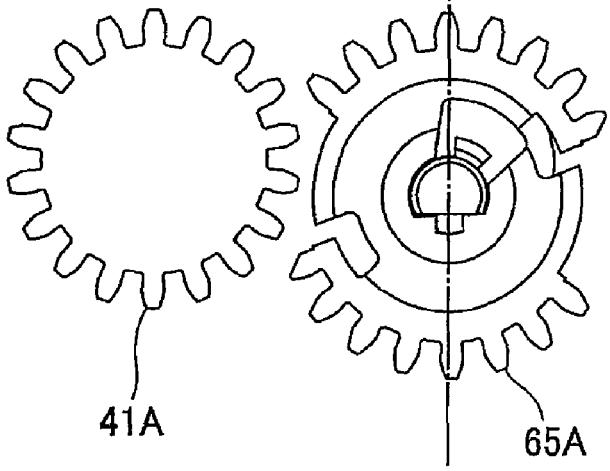
FIG. 19C is an enlarged view of a rotating gear and a notched gear in the second mode, as viewed from a line C-C in FIG. 18.

FIGS. 7 and 9 show the state of the pressing-force changing mechanism 60 when set to the second mode. In this state, the large diameter parts 69A of the cam members 69 face upward and confront the pivoting ends 61A of the pivoting arms 61. The notched gears 65A are rotated to a position in which a notched portion confronts the rotating gear 41A so that the notched gear 65A is not engaged with the rotating gear 41A (FIG. 19C). The metal shaft 65 is held by the engaging arm 67 (FIG. 19B). The coil spring 68 contacts the corner part 269C of the cam 269 to urge the cam 269 in the direction for rotating the metal shaft 65 clockwise in FIG. 19A. However, the metal shaft 65 does not rotate since the engaging arm 67 is engaged with the protruding part 66. In this state, as shown in FIGS. 7 and 9, the pivoting ends 61A of the pivoting arms 61 positioned on the left and right sides of the paper conveying belt 38 are pushed upward by the large diameter part 69A of the cam members 69 against the urging force of the second spring members 62, thereby canceling the force that the second spring members 62 apply to the backup roller 54.

Figure 13:
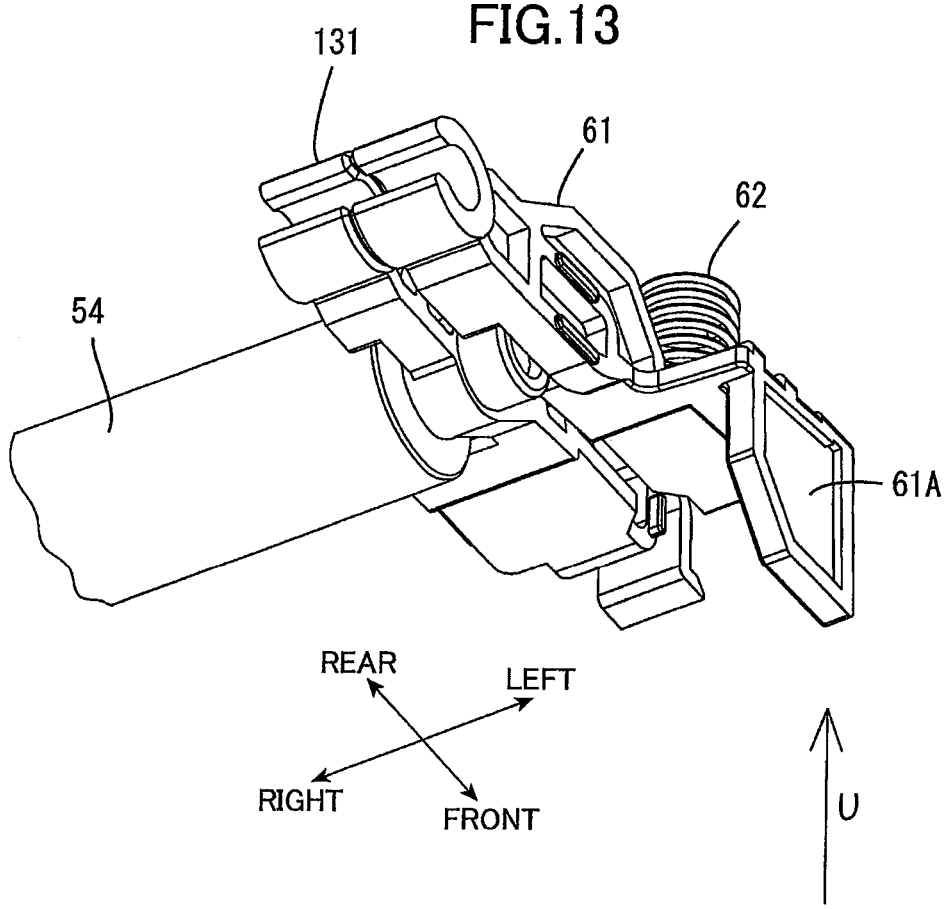
FIG. 13 is a perspective view showing part of pivoting arms, pivoting support arms, and a backup roller in the second mode.

In this state, the pivoting ends 61A of the pivoting arms 61 are pushed upward (arrow U), as shown in FIGS. 13 and 15, so that the pivoting arms 61 pivot upward about the support shaft J (see FIGS. 7 through 9), and pressing parts 61B of the pivoting arms 61 separate from pressed parts 131B of the pivoting support arms 131. Hence, the pivoting arms 61 do not press against the pivoting support arms 131 in this state. Since the second spring members 62 do not apply an urging force to the backup roller 54, only the first spring members 132 apply an urging force to the backup roller 54 (see FIG. 12; in other words, only the first spring set is used to urge the backup roller 54), resulting in a weaker cleaning nip pressure than that in the first mode. This second mode is used primarily when a cleaning operation is not being performed.

Figure 20A:
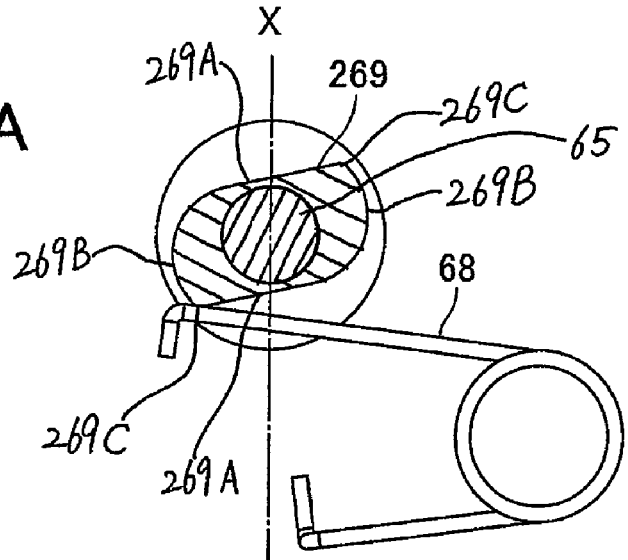
FIG. 20A is an enlarged view of the cam and the coil spring in a first intermediate state, as viewed from the line A-A in FIG. 18.
Figure 20B:
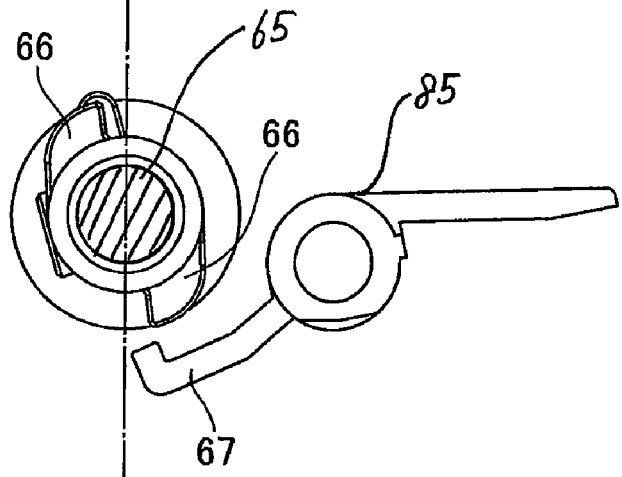
FIG. 20B is an enlarged view of the pair of protruding parts and the engaging arm in the first intermediate state, as viewed from the line B-B in FIG. 18.
Figure 20C:
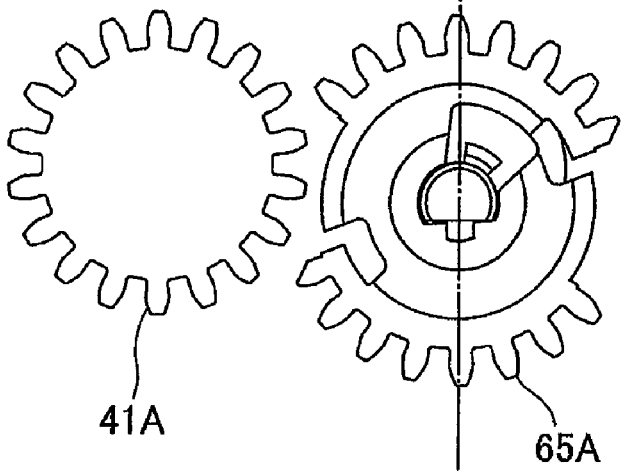
FIG. 20C is an enlarged view of the rotating gear and the notched gear in the first intermediate state, as viewed from the line C-C in FIG. 18.

During a cleaning operation, the pressing-force changing mechanism 60 is shifted from the state shown in FIGS. 7 and 9 to switch from the second mode to the first mode (first intermediate state). More specifically, when a command signal for a cleaning operation is inputted into the solenoid 80, as shown in FIG. 10, a displacement member 81 is drawn into the solenoid 80 against the urging force of a coil spring 82. The inward movement of the displacement member 81 rotates a pivoting member 83, which in turn rotates a pivoting member 85 by an end of the pivoting member 83 pushing against an end of the pivoting member 85. The rotation of the pivoting member 85 displaces the engaging arm 67. In this example, the pivoting member 83 can rotate about a shaft L indicated conceptually by a two-dot chain line, while the pivoting member 85 can rotate about a shaft 85A. In this state, as shown in FIG. 20B, the engaging arm 67 is disengaged (separated) from the protruding part 66. The parts shown in FIGS. 20A and 20C are not moved from FIGS. 19A and 19C, respectively, in this state.

Figure 21A:
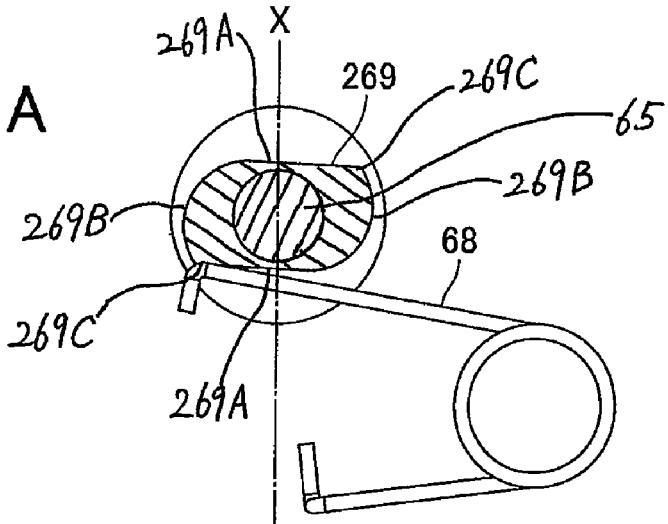
FIG. 21A is an enlarged view of the cam and the coil spring in a second intermediate state, as viewed from the line A-A in FIG. 18.
Figure 21B:
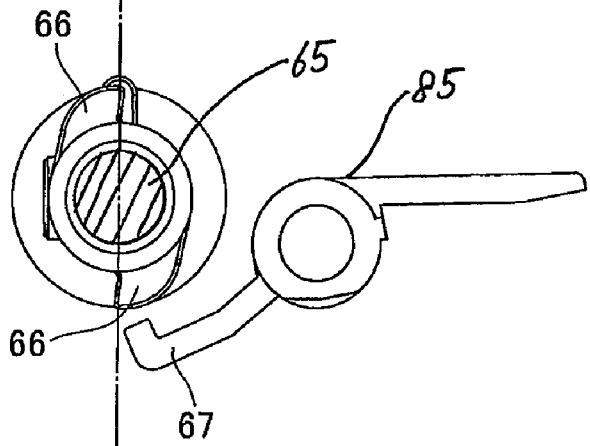
FIG. 21B is an enlarged view of the pair of protruding parts and the engaging arm in the second intermediate state, as viewed from the line B-B in FIG. 18.
Figure 21C:
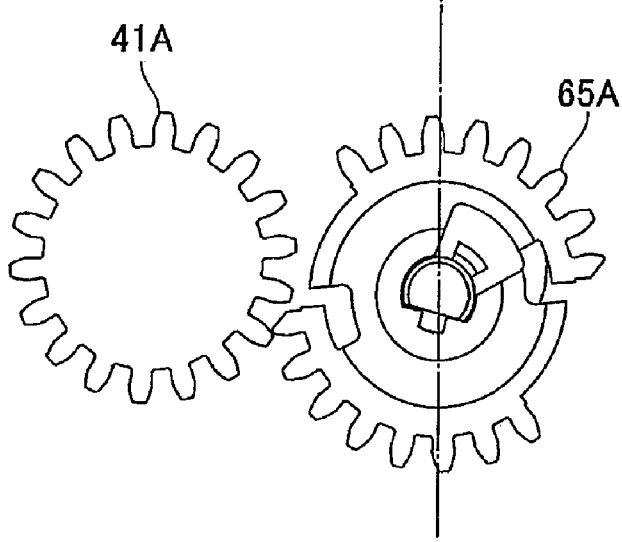
FIG. 21C is an enlarged view of the rotating gear and the notched gear in the second intermediate state, as viewed from the line C-C in FIG. 18.

The operation described above disengages the engaging arm 67 from the protruding parts 66, as shown in FIGS. 10 and 20B, allowing the urging force of the coil spring 68 to rotate the metal shaft 65 until the notched gear 65A engages with the rotating gear 41A (second intermediate state). More specifically, in this state, the engaging arm 67 is disengaged (separated) from the protruding part 66 (FIG. 21B). The coil spring 68 begins to urge the straight part 269A of the cam 269 to rotate the cam 269 clockwise in FIG. 21A. In other words, the coil spring 68 rotates the cam 269 (and the metal shaft 65). Accordingly, the notched gear 65A is rotated until the toothed part of the notched gear 65A begins to engage with the rotating gear 41A (FIG. 21C).

Figure 22A:
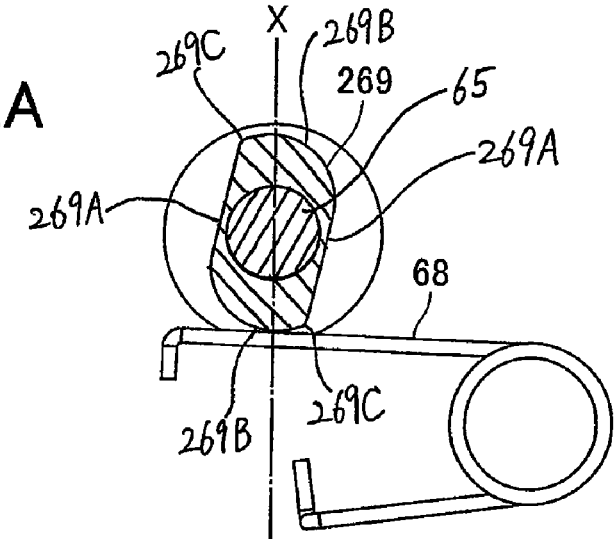
FIG. 22A is an enlarged view of the cam and the coil spring in a third intermediate state, as viewed from the line A-A in FIG. 18.
Figure 22B:
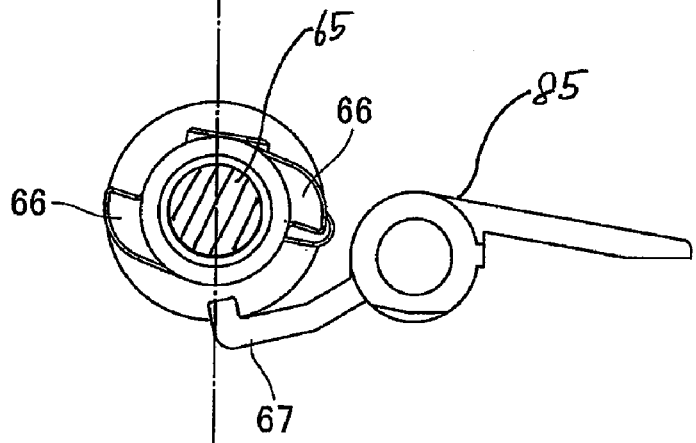
FIG. 22B is an enlarged view of the pair of protruding parts and the engaging arm in the third intermediate state, as viewed from the line B-B in FIG. 18.
Figure 22C:
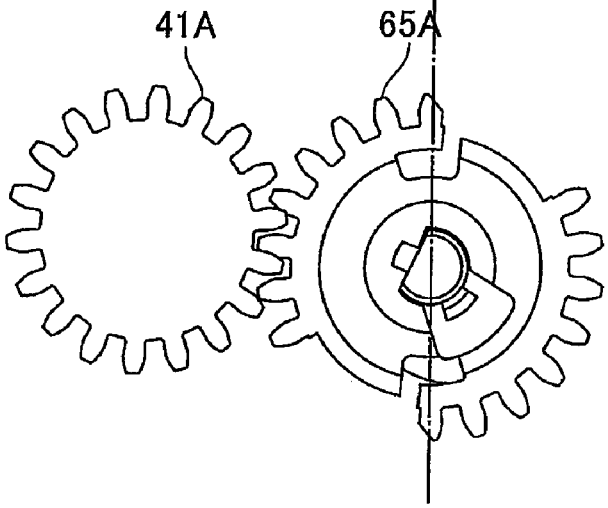
FIG. 22C is an enlarged view of the rotating gear and the notched gear in the third intermediate state, as viewed from the line C-C in FIG. 18.

Next, the signal inputted into the solenoid 80 is halted when the notched gear 65A is rotated by a predetermined angle (third intermediate state). At this time, the engaging arm 67 is returned to a position where the engaging arm 67 can engage with the protruding part 66 (FIG. 22B). The notched gear 65A continues to be rotated by the rotating gear 41A (FIG. 22C). Accordingly, the cam 269 is rotated clockwise in FIG. 22A by the gear force (gear force by the rotating gear 41A and notched gear 65A) while the round part 269B slides on the coil spring 68, until the corner part 269C gets over the contact point with the coil spring 68.

Figure 23A:
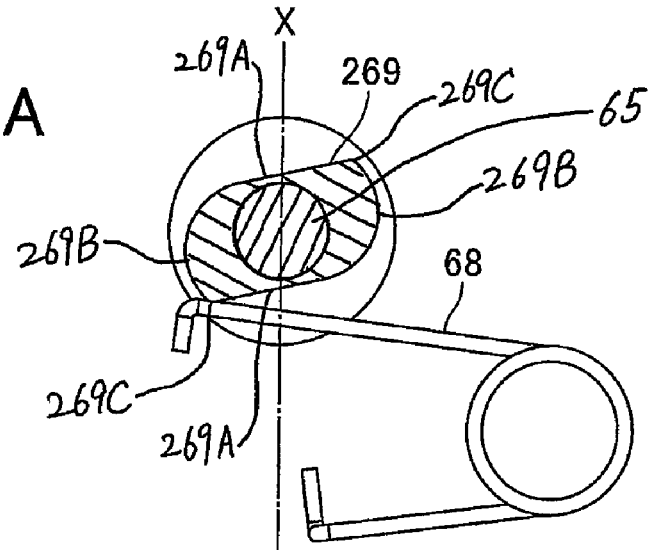
FIG. 23A is an enlarged view of the cam and the coil spring in the first mode, as viewed from the line A-A in FIG. 18.
Figure 23B:
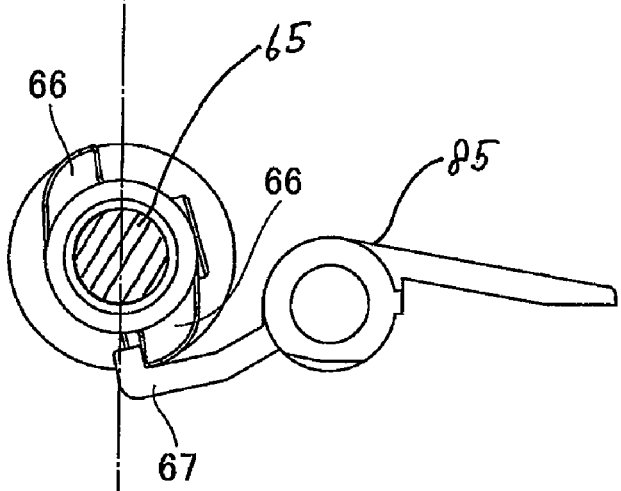
FIG. 23B is an enlarged view of the pair of protruding parts and the engaging arm in the first mode, as viewed from the line B-B in FIG. 18.
Figure 23C:
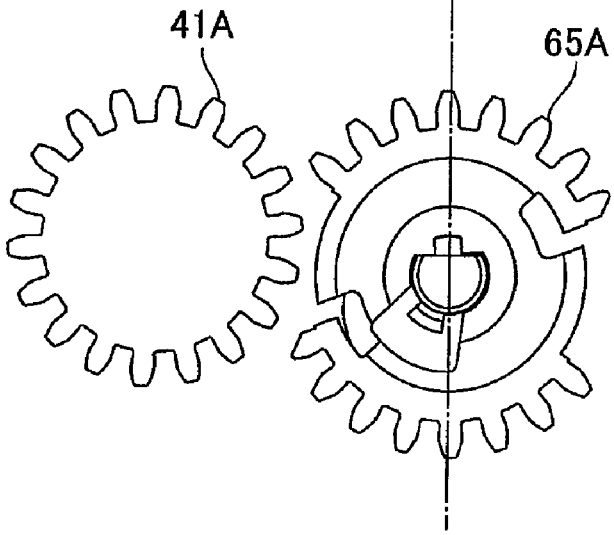
FIG. 23C is an enlarged view of the rotating gear and the notched gear in the first mode, as viewed from the line C-C in FIG. 18.
Figure 24:
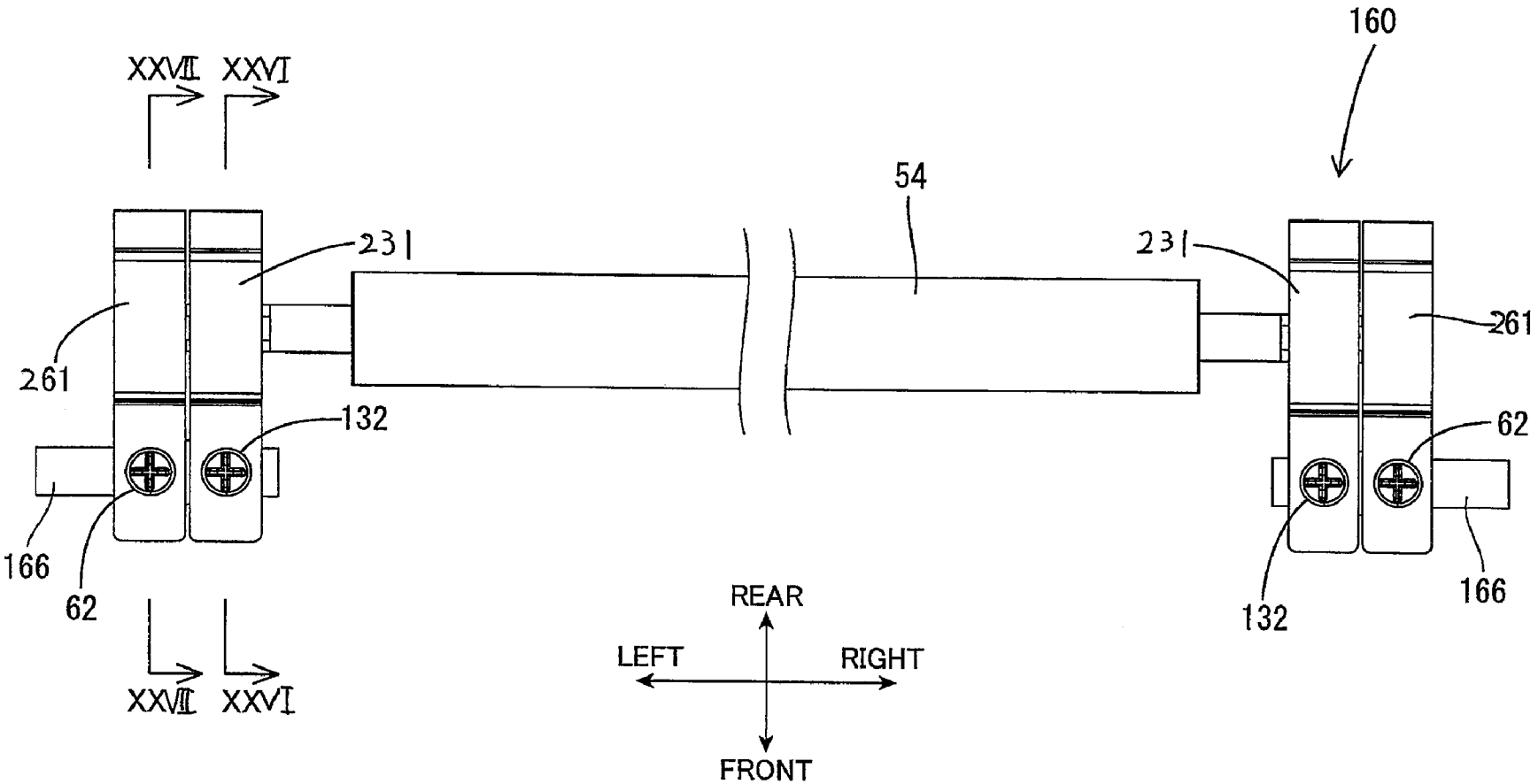
FIG. 24 is a top view showing part of a backup roller and a pressing-force changing mechanism according to a second embodiment.
Figure 25:
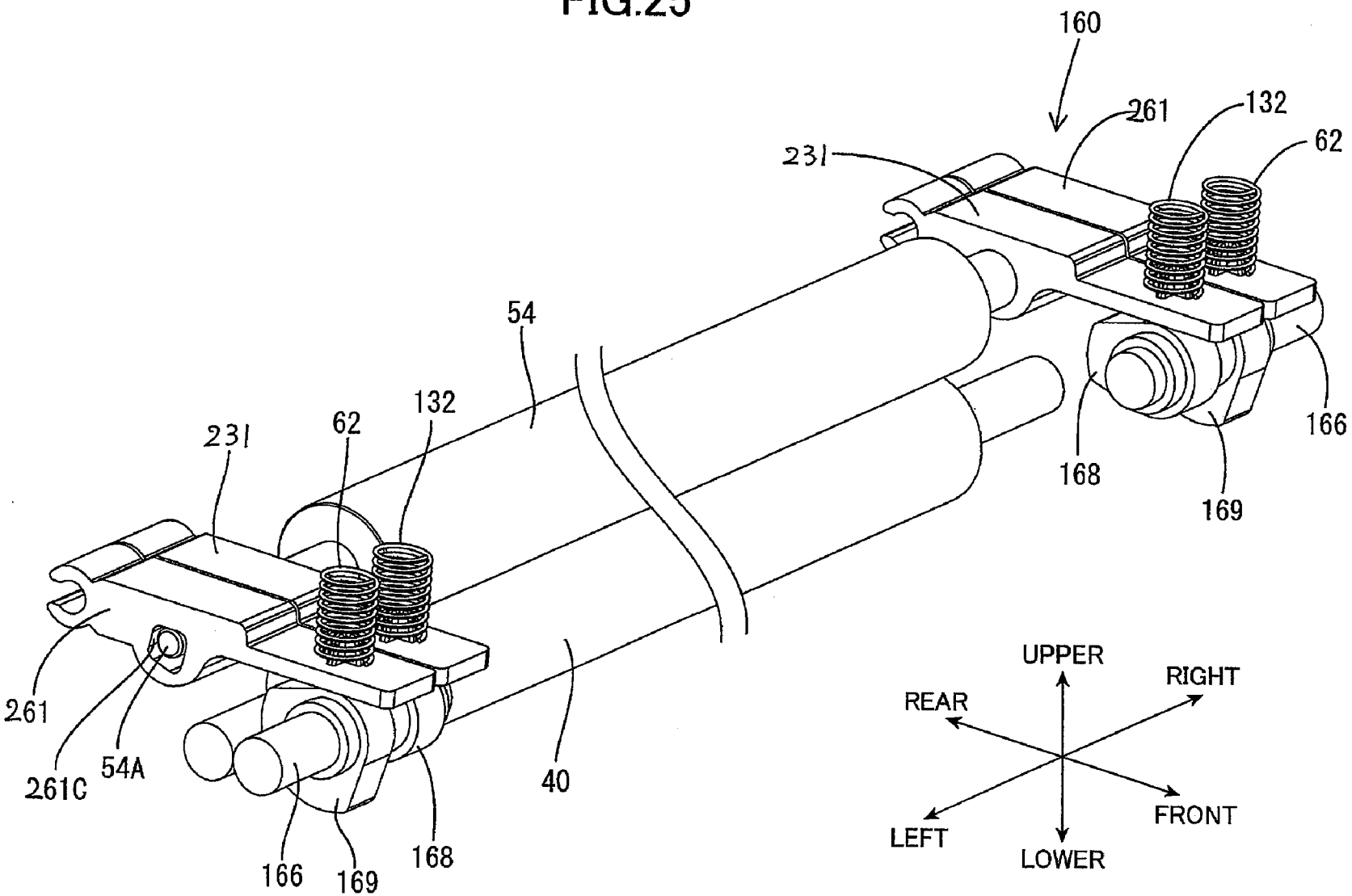
FIG. 25 is a perspective view showing part of the backup roller, the cleaning roller, and the pressing-force changing mechanism according to the second embodiment.

Then, the engaging arm 67 once again engages with the protruding part 66 to stop rotation of the metal shaft 65 as shown in FIG. 23B (first mode). A notch portion in the notched gear 65A is in a rotational position confronting the rotating gear 41A so that the notched gear 65A is not engaged with the rotating gear 41A (FIG. 23C). The coil spring 68 is in contact with the corner part 269C of the cam 269 (FIG. 23A).

Figure 8:
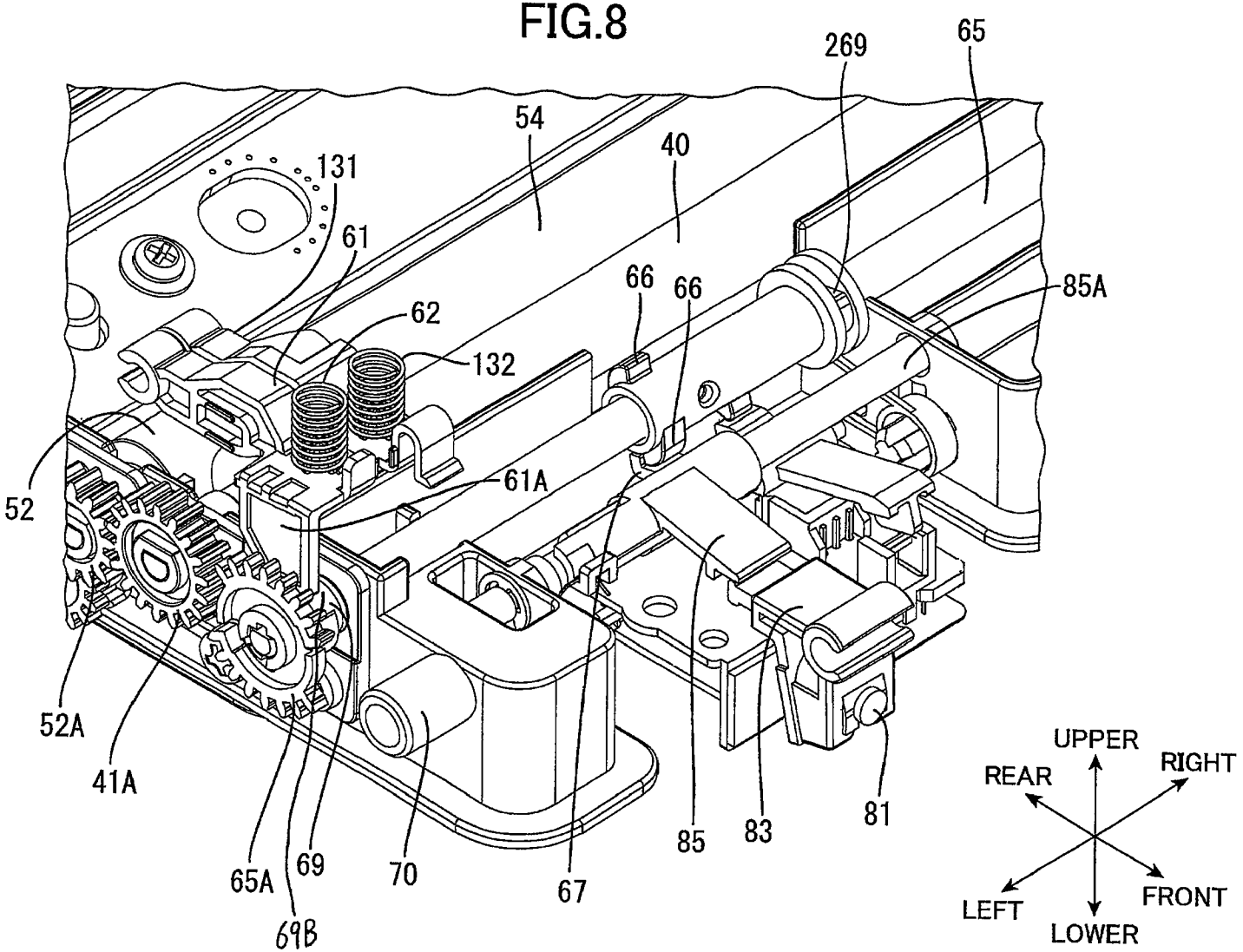
FIG. 8 is an enlarged perspective view of the pressing-force changing mechanism changed from the state shown in FIG. 7 to a first mode.

In this state, as shown in FIGS. 8 and 11, the large diameter parts 69A of the cam members 69 are pointing downward, while the small diameter parts 69B of the cam members 69 are facing upward and confront the pivoting ends 61A of the pivoting arms 61. Thus, the pivoting ends 61A of the pivoting arms 61 are pivotally moved downward by the urging force of the second spring members 62. Note that the cam members 69 are separated from the pivoting ends 61A of the pivoting arms 61.

Figure 14:
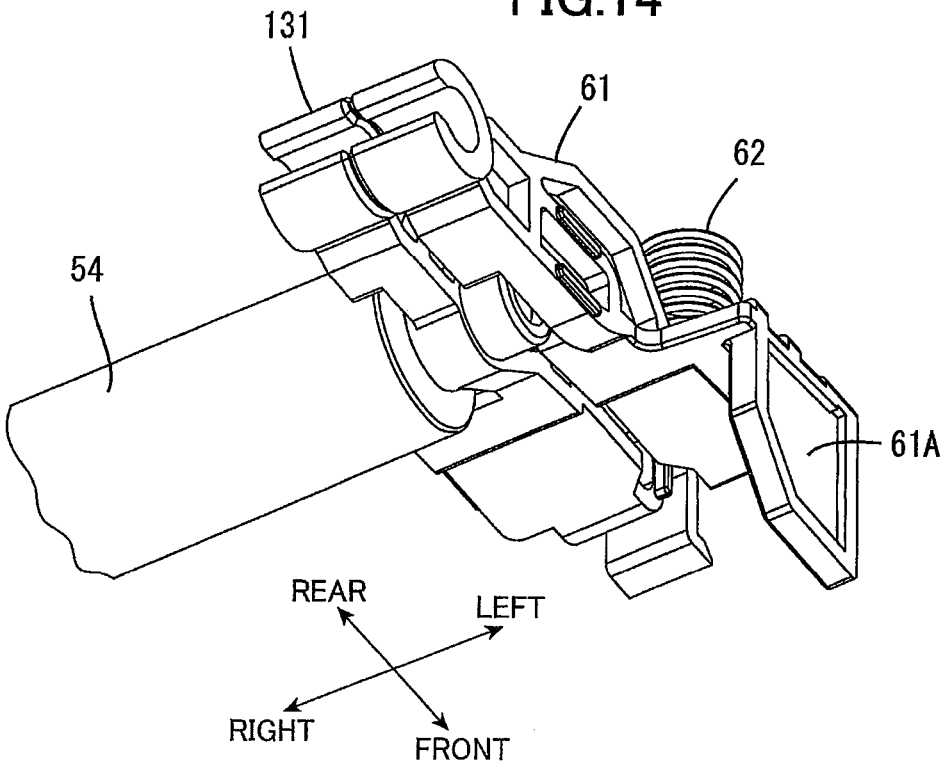
FIG. 14 is a perspective view showing part of the pivoting arms, the pivoting support arms, and the backup roller in the first mode.
Figure 17:
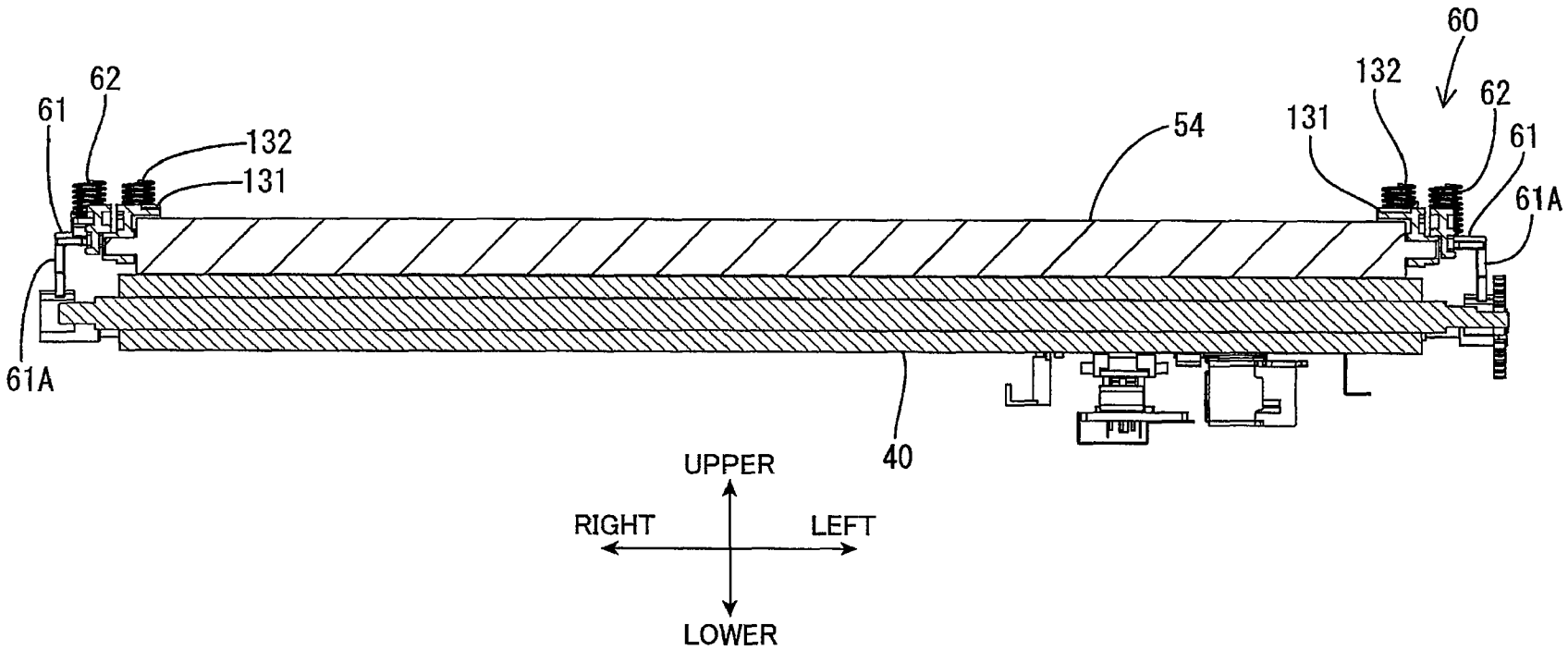
FIG. 17 is a cross-sectional view of the backup roller and the cleaning roller along the axis of the cleaning roller.

At this time, as shown in FIGS. 14 and 16, the pressing parts 61B of the pivoting arms 61 press against the pressed parts 131B of the pivoting support arms 131, while the pivoting arms 61 press against the pivoting support arms 131 (see also FIG. 17). Accordingly, both the first spring set configured of the first spring members 132 and the second spring set configured of the second spring members 62 urge the backup roller 54 so that the backup roller 54 presses against the paper conveying belt 38 with a strong urging force. As a result, the cleaning roller 40 and backup roller 54 pinch the paper conveying belt 38 with a stronger force and, consequently, the cleaning roller 40 presses against the paper conveying belt 38 with a stronger force.

When another command signal is subsequently inputted into the solenoid 80, the disengaging operation described with reference to FIG. 10 is repeated so that the metal shaft 65 rotates a half turn, thereby restoring the separated state shown in FIGS. 7 and 9.

With the construction of the above-described embodiment, the pressing-force changing mechanism 60 can appropriately change the amount of pressure that the cleaning member applies to the belt based on the circumstances. Therefore, the laser printer 1 can effectively reduce the amount of wear on the cleaning member and belt in comparison to a structure that presses the cleaning member against the belt with a constant strong force and can achieve a better cleaning performance than a structure that applies a constant weak force to the belt.

Further, since the CPU 91 controls the pressing-force changing mechanism 60 to set the pressing state of the cleaning roller 40 based on the set mode, the pressing force of the cleaning roller 40 can be increased when a large force is necessary for cleaning and can be decreased when the cleaning roller 40 is not cleaning or cleaning with less force. Accordingly, the laser printer 1 can achieve satisfactory cleaning while effectively suppressing wear on the cleaning roller 40 and the belt.

Further, the belt can be suitably cleaned by configuring the cleaning member with the cleaning roller 40, which cleans the paper conveying belt 38 with its outer surface in contact with the same. By configuring the cleaning member of a roller, it is easy to produce an electrostatic force for attracting matter deposited on the belt by applying a bias. Further, since the surface of the cleaning roller has a foam structure, the roller can readily scrape off the deposited matter. By configuring the cleaning member of a cleaning roller, the rotating speeds of the belt and cleaning roller can be varied to increase the effect of physical scraping.

Further, since the pressing-force changing mechanism 60 functions as a load switching mechanism for switching the load of the backup roller 54 applied to the cleaning roller 40, the cleaning roller 40, which tends to have complex structures in its periphery, can be supported in a fixed position while varying the force with which the cleaning roller 40 presses against the paper conveying belt 38. Hence, this construction avoids a concentration of parts on the cleaning member side and can also contribute to a reduction in cost.

By configuring the backup member of the rotatable backup roller 54, which contacts the belt with the peripheral surface thereof, friction between the backup member and belt can be reduced, thereby more effectively preventing wear on the components.

Since the overall urging force is adjusted by changing the combination of a plurality of urging members (a plurality of spring members in the embodiment), it is possible to achieve a more stable urging force than a structure that modifies the urging force by adjusting the length of a single coil spring. Further, since the stroke required for adjusting the urging force can be reduced, the structure of the embodiment is effective for circumstances in which a large amount of space cannot be allocated.

The plurality of urging members includes a first spring set configured of the pair of first spring members 132 capable of directly or indirectly urging both ends of the backup roller 54, and the second spring set configured of the pair of second spring members 62 capable of directly or indirectly urging both ends of the backup roller 54 and capable of being driven independently of the first spring set. The pressing-force changing mechanism 60 functions as a combination switching mechanism for switching between a state in which both the first and second spring sets are applied to the backup roller 54 and a state in which only one of the spring sets is applied to the backup roller 54. Accordingly, the laser printer 1 can easily adjust the urging force applied to the backup roller 54 between two stages without requiring a complex structure.

Since the urging force can be adjusted by driving the cam members 69, the structure for adjusting the urging force is simplified. Further, since the adjusting structure rotates the cam members 69, another rotational drive source can be easily employed.

Second Embodiment

An image forming apparatus according to a second embodiment of the invention will be described while referring to FIGS. 24 through 31. The second embodiment differs from the first embodiment only in a pressing-force changing mechanism 160. Since the structure in FIGS. 1 through 3 for the second embodiment is the same as that for the first embodiment, the same structure will be assumed and all members other than the pressing-force changing mechanism 160 will be designated with the same reference numerals to avoid duplicating description.

As in the first embodiment described above, a laser printer 101 (FIG. 1) according to the second embodiment includes the paper conveying belt 38 for indirectly bearing a developer image via paper, the cleaning roller 40 disposed in confrontation with the paper conveying belt 38 and configured of a roller for contacting and cleaning the paper conveying belt 38 with the outer surface thereof, and the backup roller 54 for pinching the paper conveying belt 38 with the cleaning roller 40 and configured of a rotatable roller that contacts the paper conveying belt 38 with an outer surface thereof. The pressing-force changing mechanism 160 in the second embodiment that differs from the pressing-force changing mechanism 60 in the first embodiment is configured to change the force for pressing the cleaning roller 40 against the paper conveying belt 38 when the cleaning roller 40 is in contact with the paper conveying belt 38. The CPU 91 controls operations of the pressing-force changing mechanism 160.

In the second embodiment, the CPU 91 (see FIG. 2) functions as a mode setting unit to set and change the pressing mode of the cleaning roller 40 among a first mode in which the cleaning roller 40 presses against the paper conveying belt 38 with a strong force, a second mode in which the cleaning roller 40 presses against the paper conveying belt 38 with less force than in the first mode, and a third mode in which the cleaning roller 40 is separated from the paper conveying belt 38. Functioning as a controller, the CPU 91 controls the pressing-force changing mechanism 160 to set the pressing state of the cleaning roller 40 according to the set mode.

Next, the pressing-force changing mechanism 160 will be described.

As in the first embodiment described above, the cleaning roller 40 in the second embodiment is held at a fixed support position. The pressing-force changing mechanism 160 functions as a load switching mechanism for switching the load of the backup roller 54 applied to the cleaning roller 40.

Specifically, the pressing-force changing mechanism 160 includes the first spring members 132 and the second spring members 62 capable of urging the backup roller 54 and is configured to switch the combination of spring members among these first spring members 132 and second spring members 62 used to urge the backup roller 54. In the second embodiment, the pressing-force changing mechanism 160 functions as a combination switching unit.

In the second embodiment, a roller shaft 54A of the backup roller 54 is rotatably supported in a pair of pivoting support arms 231, as in the first embodiment described above. Further, both ends of the roller shaft 54A penetrate holes 261C formed in a pair of pivoting arms 261. The openings in the holes 261C are slightly larger than the diameter of the roller shaft 54A and noncircular in shape.

The pressing-force changing mechanism 160 includes a first spring set configured of the first spring members 132 capable of indirectly urging both ends of the backup roller 54 via the pivoting support arms 231, and a second spring set configured of the second spring members 62 capable of indirectly urging both ends of the backup roller 54 via the pivoting arms 261. The pressing-force changing mechanism 160 is configured to switch between a state in which both the first and second spring sets are applied to the backup roller 54, and a state in which only one of the spring sets is applied to the backup roller 54.

Figure 26:
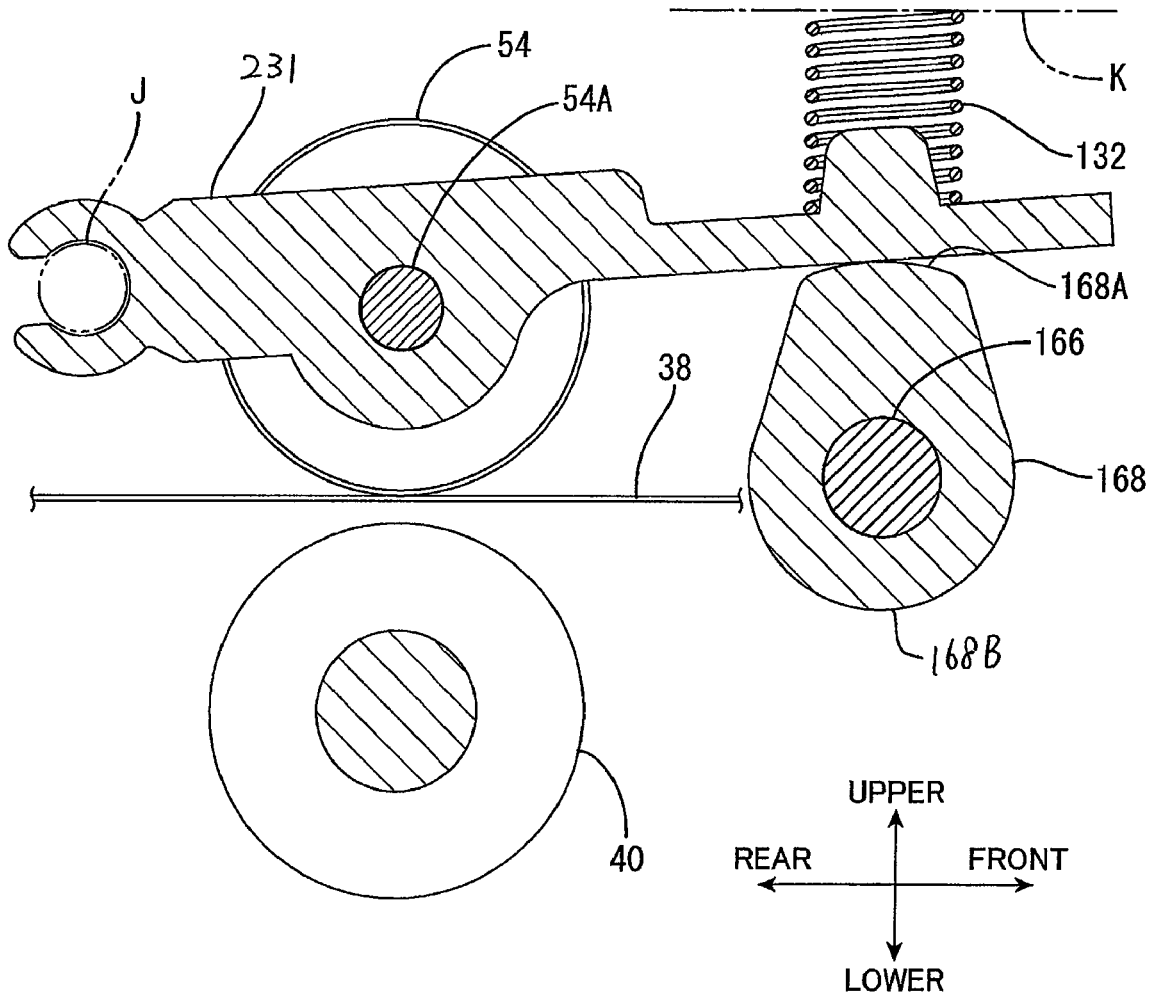
FIG. 26 is a cross-sectional view of the pressing-force changing mechanism in a third mode along a line XXVI-XXVI shown in FIG. 24.
Figure 27:
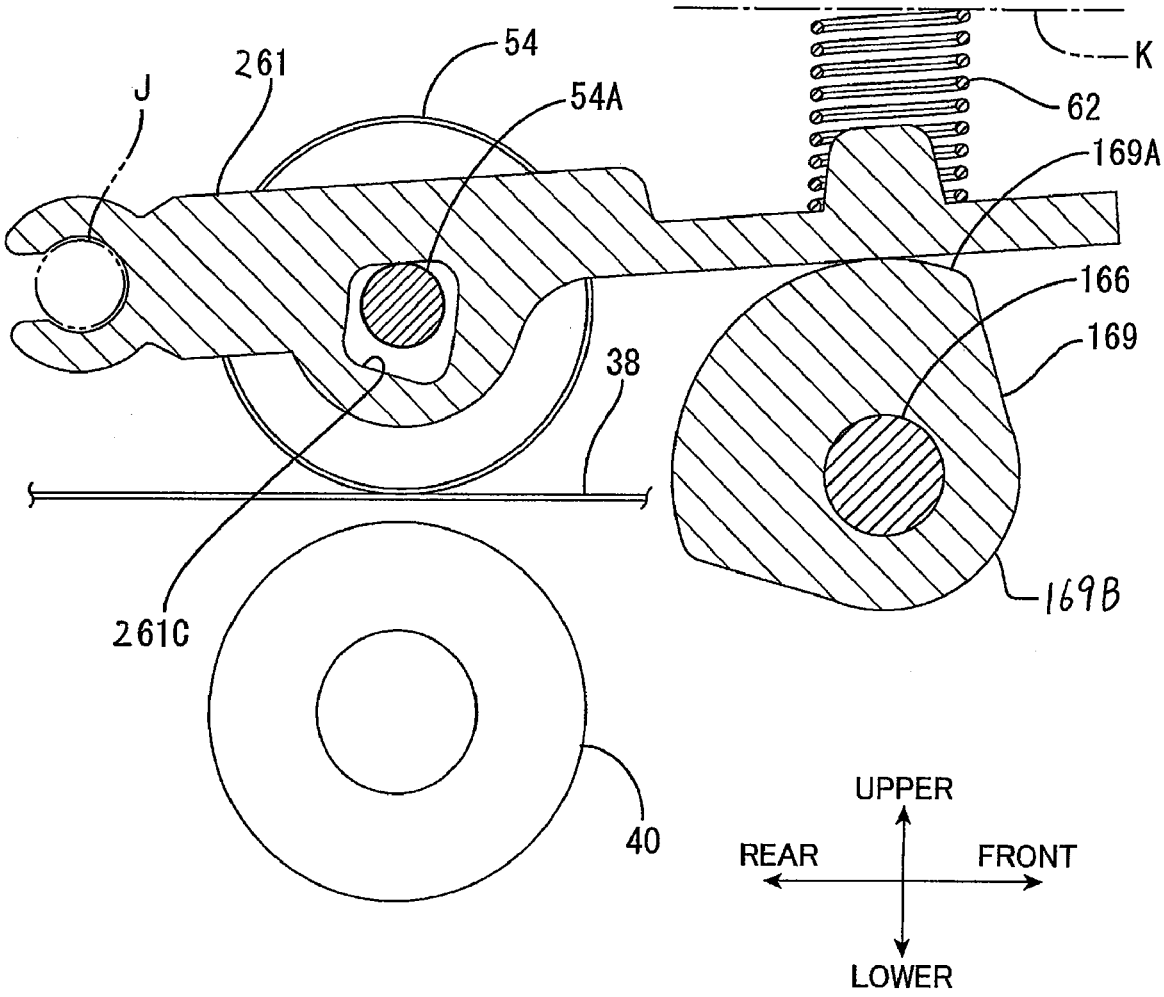
FIG. 27 is a cross-sectional view of the pressing-force changing mechanism in a third mode along a line XXVII-XXVII shown in FIG. 24.
Figure 28:
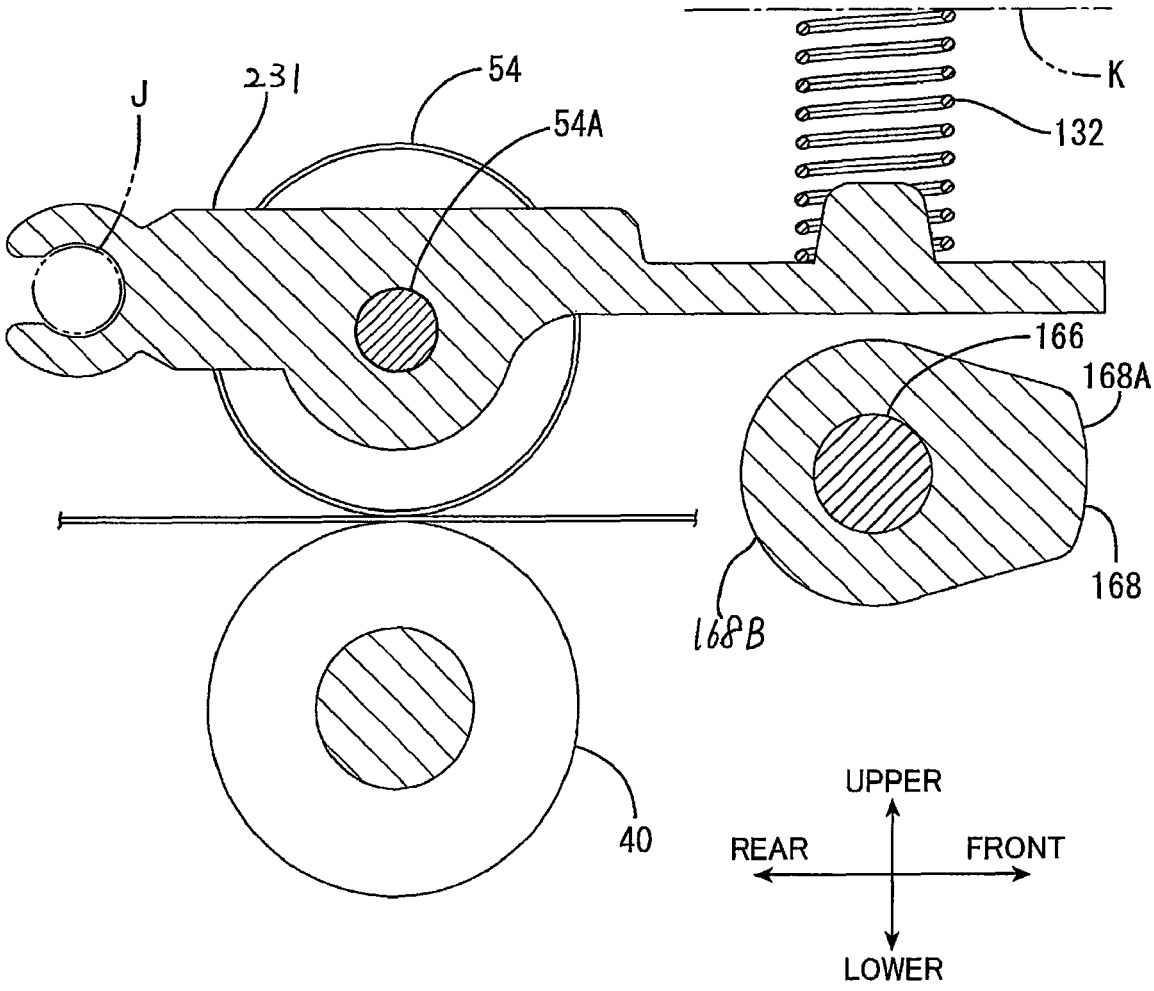
FIG. 28 is a cross-sectional view of the pressing-force changing mechanism in a second mode along the line XXVI-XXVI shown in FIG. 24.
Figure 29:
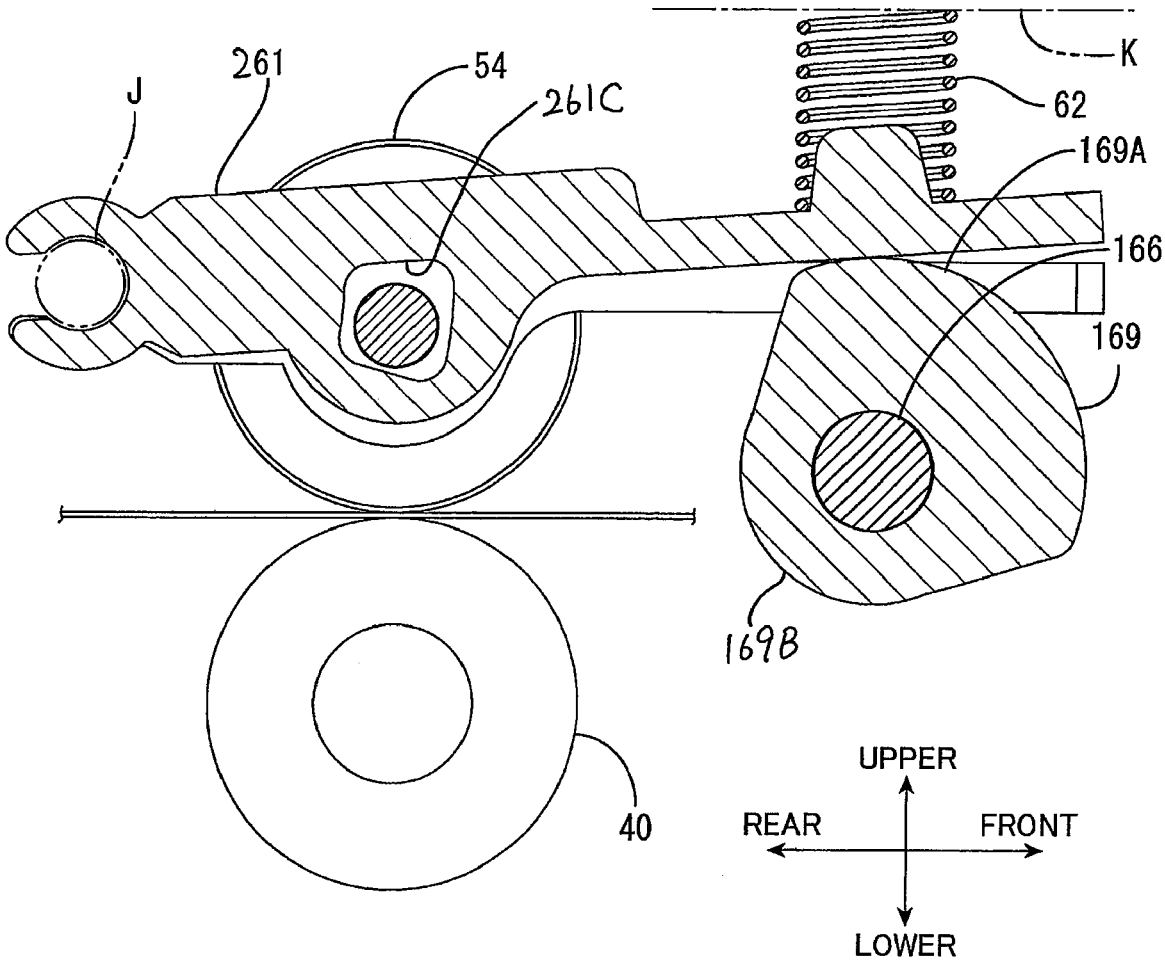
FIG. 29 is a cross-sectional view of the pressing-force changing mechanism in a second mode along the line XXVII-XXVII shown in FIG. 24.
Figure 30:
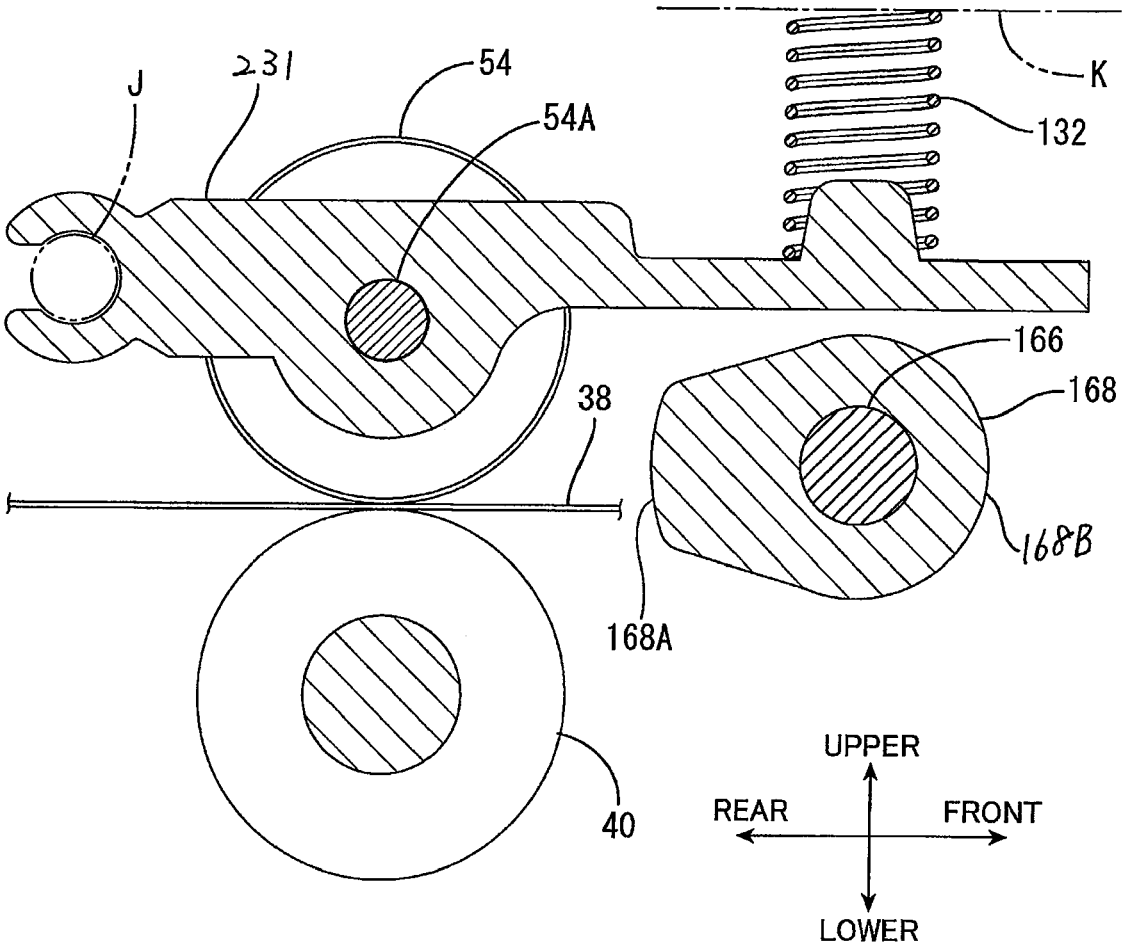
FIG. 30 is a cross-sectional view of the pressing-force changing mechanism in a first mode along the line XXVI-XXVI shown in FIG. 24.
Figure 31:
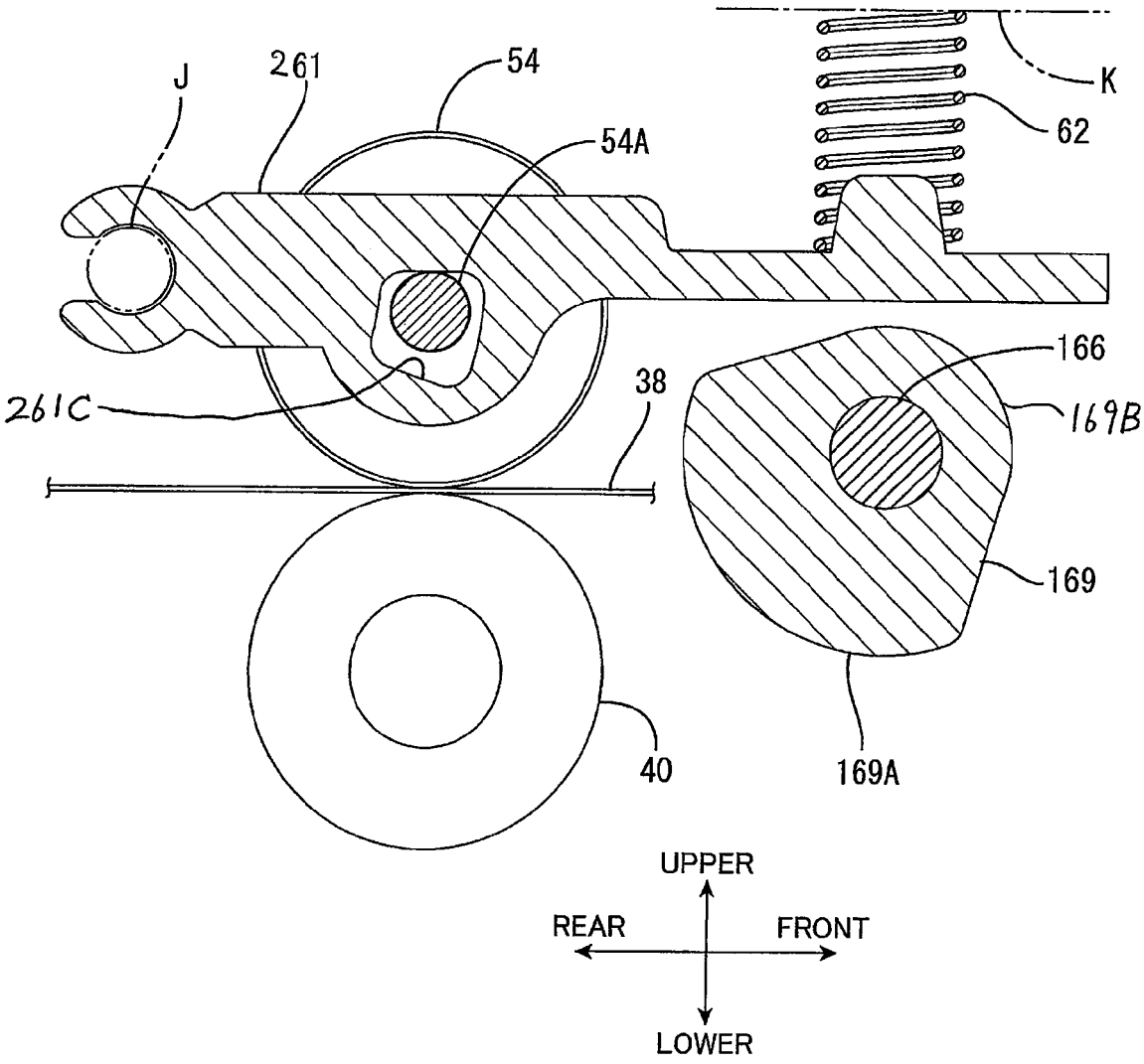
FIG. 31 is a cross-sectional view of the pressing-force changing mechanism in a first mode along the line XXVII-XXVII shown in FIG. 24.

The pressing-force changing mechanism 160 is provided with a pair of cam members 168 and a pair of cam members 169. The cam members 168 and 169 are disposed to correspond to each of the spring members 62 and 132 and are configured to drive the spring members 62 and 132 through self-displacement. Each cam member 168 has a large diameter part 168A and a small diameter part 168B (FIGS. 26, 28, and 30). Similarly, each cam member 169 has a large diameter part 169A and a small diameter part 169B (FIGS. 27, 29, and 31). The large diameter part 169A of the cam member 169 is formed in a larger region (i.e., a larger angle about the rotation axis of the shaft 166) than the large diameter part 168A of the cam member 168. In the present embodiment, the pivoting arms 261 independently displace the pivoting support arms 231 through the operation of the cam members 169, while the pivoting support arms 231 independently displace the pivoting arms 261 through the operation of the cam members 168.

In the present embodiment, shafts 166 of the cam members 169 can be set to a first rotational displacement shown in FIGS. 30 and 31, a second rotational displacement shown in FIGS. 28 and 29, and a third rotational displacement shown in FIGS. 26 and 27. The positions of the shafts 166 can be set using a stepping motor. In this case, the stepping motor and the shafts 166 serve as the cam member driving mechanism.

The cam member driving mechanism may also be implemented according to the similar configuration described in the first embodiment. In this case, instead providing two protruding parts 66 as shown in FIG. 9 of the first embodiment, three protruding parts 66 should be provided to correspond to the first through three rotational displacements. In this case, a notched gear (similar to the notched gear 65A described in the first embodiment) is fixed on an end of the shaft 166 and has three notched portions formed in regions that confront the rotating gear 41A when the engaging arm 67 is engaged with one of the three protruding parts so that the notched gear is not engaged with the rotating gear 41A.

Next, the operations of the pressing-force changing mechanism 160 will be described.

FIGS. 26 and 27 show the pressing-force changing mechanism 160 set in the third mode in which the cleaning roller 40 is separated from the paper conveying belt 38. In this mode, the shafts 166 are set to the third rotational displacement so that the cam members 168 and cam members 169 fixed on the shafts 166 are in the third displacement state shown in FIGS. 26 and 27 (only one cam member is shown in each of FIGS. 26 and 27). In this state, the large diameter parts 168A of the cam members 168 are set in a top position for contacting the front ends of the pivoting support arms 231, pushing the front ends of the pivoting support arms 231 upward so that the urging force of the first spring members 132 is not applied to the backup roller 54.

Further, the large diameter parts 169A of the cam members 169, which operate in association with the cam members 168 via the shafts 166, are set in a top position for contacting the front ends of the pivoting arms 261, thereby pushing the front ends of the pivoting arms 261 upward so that the urging force of the second spring members 62 is not applied to the backup roller 54. Since none of the spring members applies an urging force to the backup roller 54, the backup roller 54 does not press against the paper conveying belt 38. Hence, the paper conveying belt 38, which is pressed slightly downward during cleaning, rises slightly upward by its own tension and separates from the cleaning roller 40. In this case, the backup roller 54 does not apply a load to the cleaning roller 40.

FIGS. 28 and 29 show the pressing-force changing mechanism 160 set in the second mode in which the pressing force is less than in the first mode. In the second mode, the shafts 166 are set to the second rotational displacement so that the cam members 168 and cam members 169 fixed on the shafts 166 are in the second displacement state shown in FIGS. 28 and 29 (only one cam member is shown in each of FIGS. 28 and 29). In this state, the large diameter parts 168A of the cam members 168 are set in a side position not contacting the front ends of the pivoting support arms 231 and, therefore, do not push upward on the front ends of the pivoting support arms 231. Instead, the small diameter parts 168B of the cam members 168 confront the front ends of the pivoting support arms 231 with a space therebetween. Accordingly, the urging force of the first spring members 132 is applied to the backup roller 54 via the pivoting support arms 231.

However, since the large diameter parts 169A of the cam members 169 are set in the top position for contacting the front ends of the pivoting arms 261, the large diameter parts 169A still push upward on the front ends of the pivoting arms 261 as in the third mode so that the urging force of the second spring members 62 is still not applied to the backup roller 54. Hence, in this case, only the urging force of the first spring members 132 is applied to the backup roller 54, and the load of the backup roller 54 on the cleaning roller 40 is weaker than when all first spring members 132 and second spring members 62 urge the backup roller 54.

FIGS. 30 and 31 show the pressing-force changing mechanism 160 set in the first mode in which the pressing force is set higher than that in the second mode. In this mode, the shafts 166 are set to the first rotational displacement so that the cam members 168 and cam members 169 fixed on the shafts 166 are in the first displacement state shown in FIGS. 30 and 31 (only one cam member is shown in each of FIGS. 30 and 31). In this state, the large diameter parts 168A of the cam members 168 are set in a side position so as not to contact the front ends of the pivoting support arms 231 and, therefore, do not push upward on the front ends of the pivoting support arms 231. The small diameter parts 168B of the cam members 168 confront the front ends of the pivoting support arms 231 with a space therebetween. Hence, the urging force of the first spring members 132 is applied to the backup roller 54 via the pivoting support arms 231.

Further, the large diameter parts 169A of the cam members 169 are set in a position for not contacting the front ends of the pivoting arms 261 and, therefore, do not push upward on the front ends of the pivoting arms 261. The small diameter parts 169B of the cam members 169 confront the front ends of the pivoting arms 261 with a space therebetween. Accordingly, the urging force of the second spring members 62 is applied to the backup roller 54. In this case, both the urging forces of the first spring members 132 and the second spring members 62 are applied to the backup roller 54 so that the load of the backup roller 54 on the cleaning roller 40 is greater than when only the first spring members 132 are urging the backup roller 54. Accordingly, the cleaning roller 40 can press the paper conveying belt 38 with a stronger force than in the second mode.

The laser printer 101 according to the second embodiment can obtain the same effects as the laser printer 1 of the first embodiment. In addition, the pressing-force changing mechanism 160 can separate the cleaning roller 40 from the belt during a non-cleaning operation to further reduce wear on the cleaning roller 40 and paper conveying belt 38 and can perform suitable cleaning according to the circumstances.

Third Embodiment

Figure 32:
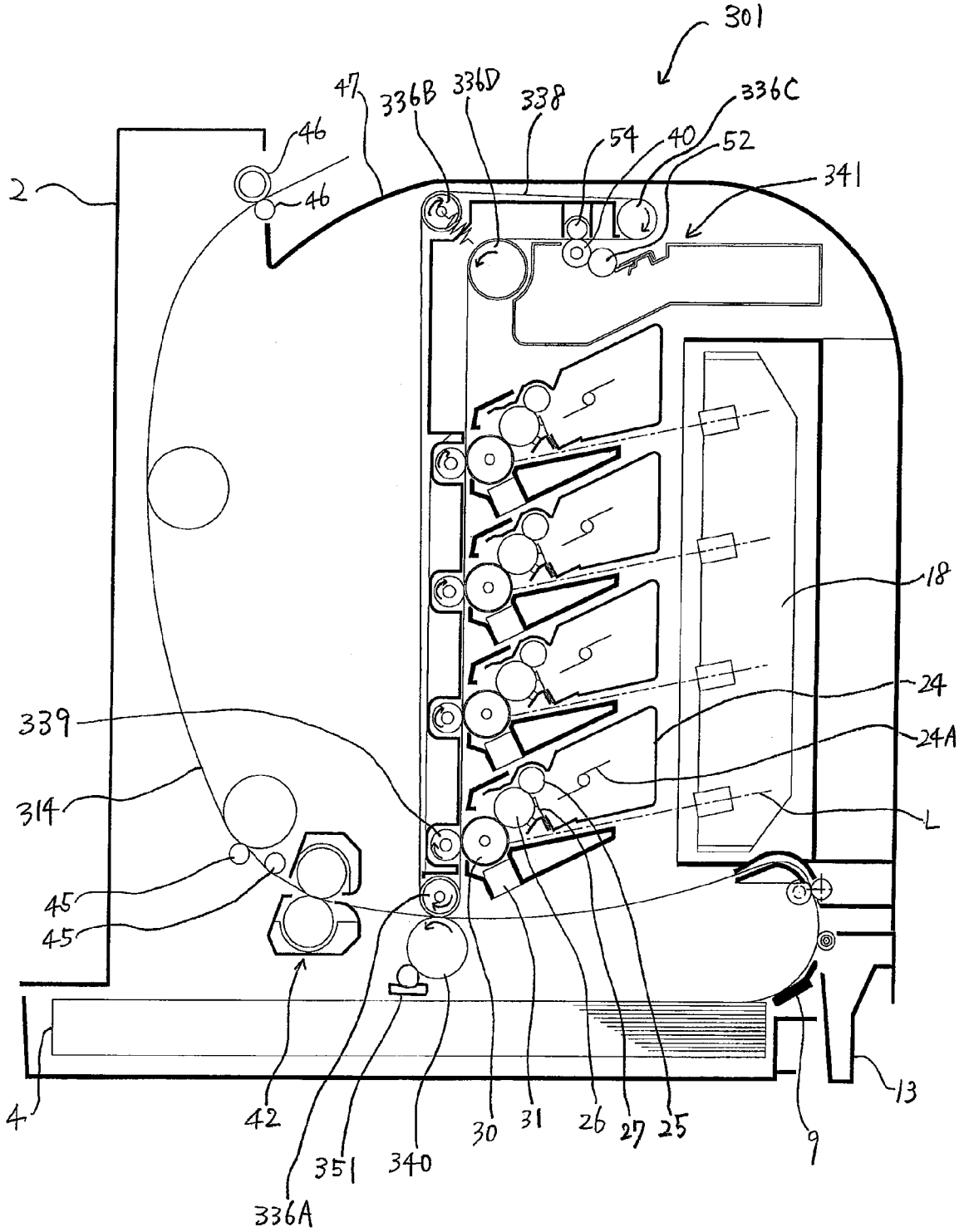
FIG. 32 is a side cross-sectional view showing the general structure of an intermediate-transfer-belt type laser printer serving as an image forming apparatus according to a third embodiment of the invention.

An image forming apparatus according to a third embodiment of the invention will be described while referring to FIG. 32, wherein like parts and components are designated by the same reference numerals to avoid duplicating description.

In conveying-belt type laser printers in the above-described first and second embodiments, developer images are transferred from a photosensitive member to a printing medium. In contrast, in an intermediate-transfer type laser printer 301 in the third embodiment, developer images are transferred from a photosensitive member to an intermediate transfer belt 338 (a first transfer operation) and then transferred from the intermediate transfer belt 338 to a printing medium (a second transfer operation).

In the laser printer 301, the intermediate transfer belt 338 is looped around belt support rollers 336A, 336B, and 336C. The intermediate transfer belt 338 is also supported on a belt support roller 336D to form a substantially L-shape. Four of first transfer rollers 339 are provided in confrontation with respective ones of the photosensitive drums 30 with the intermediate transfer belt 338 interposed therebetween. Note that the arrows in the first transfer rollers 339 and the like indicate rotational directions of the rollers.

A cleaning unit 341 is provided for cleaning the intermediate transfer belt 338. The cleaning unit 341 has a casing shape that is different from the cleaning unit 41 in the above-described embodiments, but the configuration of components such as the cleaning roller 40 and metal roller 52 is the same as those in the cleaning unit 41. Therefore, detailed descriptions of the cleaning unit 341 are omitted.

A second transfer roller 340 is also provided in confrontation with the belt support roller 336A with the intermediate transfer belt 338 interposed therebetween. A paper conveying path 314 is formed between the intermediate transfer belt 338 and the second transfer roller 340. A second-transfer-roller cleaning unit 351 is provided for removing toner, paper dust, or other foreign matter deposited on the second transfer roller 340.

With the above-described configuration, first, developer images are formed on the photosensitive drums 30 through well-known charging, scanning (exposure), and developing operations. Then, the developer images are transferred from the photosensitive drums 30 to the intermediate transfer belt 338 by the first transfer rollers 339. This transfer operation (the first transfer operation) is repeated for sequentially superimposing Y, M, C, and K toners to form a color image.

With a circuitous movement of the intermediate transfer belt 338, the developer images on the intermediate transfer belt 338 are transferred to a printing medium such as paper or other sheet-like medium at a nip position between the intermediate transfer belt 338 (the belt support roller 336A) and the second transfer roller 340 (the second transfer operation).

Next, the printing medium on which the developer images are transferred passes through the fixing unit 42, at which the developer images are thermally fixed to the printing medium. The printing medium is then discharged onto the discharge tray 47.

After the intermediate transfer belt 338 transfers the developer images to the printing medium, the cleaning unit 341 performs cleaning of residual toner and the like on the intermediate transfer belt 338 to prepare for the subsequent transfer operation. At this time, the second-transfer-roller cleaning unit 351 performs cleaning of residual toner and the like on the second transfer roller 340.

While the invention has been described in detail with reference to the above aspects thereof, it would be apparent to those skilled in the art that various changes and modifications may be made therein without departing from the spirit of the invention.

Figure 33:
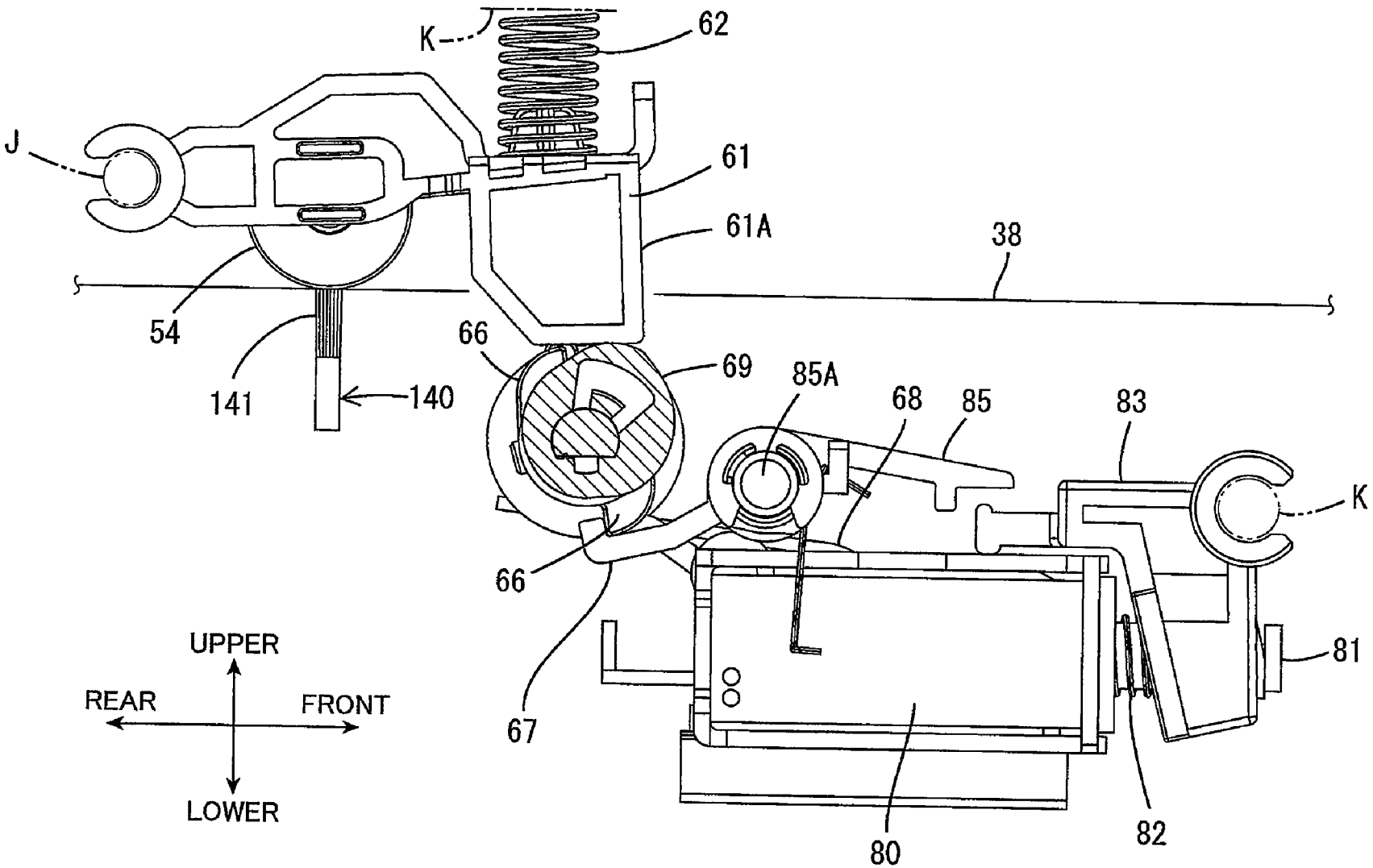
FIG. 33 is a side cross-sectional view corresponding to FIG. 9 of the pressing-force changing mechanism employing a cleaning member according to a modification.

(1) In the embodiments described above, the cleaning roller 40 is used as an example of the cleaning member. However, in the structure of either embodiment, the cleaning member may instead be configured of a cleaning brush 140 having a plurality of flexible members 141, as shown in FIG. 33. The ends of the flexible members 141 contact and clean the belt 38. The flexible members 141 can be formed of a fibrous material, resinous material, or the like.

(2) While the cleaning member in the embodiments described above is configured of the cleaning roller 40, in either embodiment, the cleaning member may be configured of a cleaning blade formed of a thin plate structure. The cleaning blade is configured to scrape off matter deposited on the belt.

(3) In the embodiments described above, the cleaning unit 41 is configured to be detachable from the main body of the laser printer 1 or 101, but the cleaning unit 41 may be configured to be nondetachable instead.

(4) In the embodiments described above, the cleaning member is held in a fixed support position, while a pressing-force changing mechanism has a load switching mechanism for switching the load of the backup member on the cleaning member, but the invention is not limited to this example. For example, the backup member may be held at a fixed support position while the load switching mechanism switches the load of the cleaning member on the backup member, or both the cleaning member and the backup member can be driven.

(5) In the embodiments described above, the pressing-force changing mechanism is capable of changing the pressing force of the cleaning member on the belt in two stages when the cleaning roller 40 is in contact with the paper conveying belt 38, but the pressing-force changing mechanism may be configured to change the pressing force in three or more stages.

What is claimed is:

1. An image forming apparatus comprising:

a belt;

a cleaning member disposed in confrontation with the belt and having a longitudinal length;

a backup member that has a longitudinal length and is disposed to pinch the belt in cooperation with the cleaning member, the longitudinal length of the backup member being smaller than the longitudinal length of the cleaning member;

a pressing mechanism that is configured to press the backup member to the cleaning member for applying a pressing force acting between the cleaning member and the belt;

a pressing-force changing mechanism that is configured to change the pressing force acting between the cleaning member and the belt in a state in which the cleaning member is in contact with the belt; and a control unit that controls the pressing-force changing mechanism to change the pressing force.

2. The image forming apparatus according to claim 1, further comprising a mode setting unit that selectively sets a pressing mode of the pressing force to:

a first mode in which a first pressing force acts between the cleaning member and the belt; and a second mode in which a second pressing force smaller than the first pressing force acts between the cleaning member and the belt, wherein the control unit controls the pressing-force changing mechanism such that the cleaning member is in a pressing state corresponding to the pressing mode set by the mode setting unit.

3. The image forming apparatus according to claim 1, further comprising a mode setting unit that selectively sets a pressing mode of the pressing force to:

a first mode in which a first pressing force acts between the cleaning member and the belt;

a second mode in which a second pressing force smaller than the first pressing force acts between the cleaning member and the belt; and a third mode in which the cleaning member and the belt are separated from each other, wherein the control unit controls the pressing-force changing mechanism such that the cleaning member is in a pressing state corresponding to the pressing mode set by the mode setting unit.

4. The image forming apparatus according to claim 1, wherein the cleaning member comprises a cleaning roller having an outer peripheral surface that is configured to contact and clean the belt.

5. The image forming apparatus according to claim 1, wherein the cleaning member comprises a cleaning brush having a plurality of flexible members whose end parts are configured to contact and clean the belt.

6. The image forming apparatus according to claim 1, wherein the cleaning member is held at a fixed support position; and wherein the pressing-force changing mechanism comprises a load switching mechanism that is configured to switch a load for pressing the backup member against the cleaning member.

7. The image forming apparatus according to claim 6, wherein the backup member comprises a backup roller having an outer peripheral surface that is configured to rotatably contact the belt.

8. The image forming apparatus according to claim 6, wherein the pressing-force changing mechanism comprises:

a plurality of urging members each being capable of urging the backup member; and a combination switching unit that switches states of the plurality of urging members used for urging the backup member.

9. The image forming apparatus according to claim 8, wherein the backup member has both ends in a longitudinal direction;

wherein the plurality of urging members comprises:

a first spring set including a pair of first spring members capable of urging the both ends of the backup member; and a second spring set including a pair of second spring members capable of urging the both ends of the backup member and capable of being driven independently of the first spring set; and wherein the combination switching unit is configured to switch between a high-pressure state in which both the first and second spring sets are applied to the backup member and a low-pressure state in which only one of the first and second spring sets is applied to the backup member.

10. The image forming apparatus according to claim 8, wherein the pressing-force changing mechanism comprises:

a plurality of cam members each being disposed in correspondence with respective ones of the plurality of urging members and being capable of driving the respective ones of the plurality of urging members through self-displacement; and a cam-member driving mechanism that drives the plurality of cam members to rotate.

11. The image forming apparatus according to claim 1, wherein the pressing-force changing mechanism comprises:

a plurality of pivoting members each having a pivoting end;

a plurality of urging members that is provided at respective ones of the plurality of pivoting members and that is configured to urge the pivoting end of the respective ones of the plurality of pivoting members; and a cam member that is provided for at least one of the plurality of pivoting members, the cam member having a large diameter part and a small diameter part, the cam member being configured to prohibit a corresponding one of the plurality of urging members from applying an urging force to the cleaning member when the large diameter part contacts the pivoting end of the at least one of the plurality of pivoting members, the cam member being configured to allow the corresponding one of the plurality of urging members to apply an urging force to the cleaning member when the small diameter part confronts the pivoting end of the at least one of the plurality of pivoting members.

12. The image forming apparatus according to claim 11, wherein the plurality of pivoting members comprises:

a first pivoting member that supports either one of the cleaning member and the backup member; and a second pivoting member that is capable of pivotally moving to contact the first pivoting member;

wherein the plurality of urging members comprises:

a first urging member that is provided at the first pivoting member to urge the pivoting end of the first pivoting member; and a second urging member that is provided at the second pivoting member to urge the pivoting end of the second pivoting member;

wherein the cam member is configured to move the second pivoting member to separate from the first pivoting member, thereby prohibiting the second urging member from applying the urging force to the cleaning member when the large diameter part contacts the pivoting end of the second pivoting member; and wherein the cam member is configured to move the second pivoting member to contact the first pivoting member, thereby allowing the second urging member to apply the urging force to the cleaning member when the small diameter part confronts the pivoting end of the second pivoting member.

13. The image forming apparatus according to claim 11, wherein the plurality of pivoting members comprises:

a first pivoting member that supports either one of the cleaning member and the backup member; and a second pivoting member that is capable of pivotally moving about a same axis as the first pivoting member;

wherein the plurality of urging members comprises:

a first urging member that is provided at the first pivoting member to urge the pivoting end of the first pivoting member; and a second urging member that is provided at the second pivoting member to urge the pivoting end of the second pivoting member;

wherein the cam member comprises:

a first cam member that is rotatable about a cam shaft and that is capable of contacting the first pivoting member; and a second cam member that is rotatable about the cam shaft and that is capable of contacting the second pivoting member;

wherein the first cam member is configured to prohibit the first urging member from applying the urging force to the cleaning member when the large diameter part contacts the pivoting end of the first pivoting member and is configured to allow the first urging member to apply the urging force to the cleaning member when the small diameter part confronts the pivoting end of the first pivoting member; and wherein the second cam member is configured to prohibit the second urging member from applying the urging force to the cleaning member when the large diameter part contacts the pivoting end of the second pivoting member and is configured to allow the second urging member to apply the urging force to the cleaning member when the small diameter part confronts the pivoting end of the second pivoting member.

14. The image forming apparatus according to claim 1, wherein the belt is configured to convey a recording medium bearing a developer image.

15. The image forming apparatus according to claim 1, wherein the belt is configured to bear a developer image.

16. An image forming apparatus comprising:

a belt;

a cleaning member disposed in confrontation with the belt and having a predetermined width;

a backup member that is disposed to pinch the belt in cooperation with the cleaning member, a width of the backup member being narrower than the width of the cleaning member;

a pressing mechanism that is configured to press the backup member to the cleaning member for applying a pressing force acting between the cleaning member and the belt;

a pressing-force changing mechanism that is configured to change the pressing force acting between the cleaning member and the belt in a state in which the cleaning member is in contact with the belt; and a control unit that controls the pressing-force changing mechanism to change the pressing force, wherein the pressing-force changing mechanism comprises:

a plurality of pivoting members each having a pivoting end;

a plurality of urging members that is provided at respective ones of the plurality of pivoting members and that is configured to urge the pivoting end of the respective ones of the plurality of pivoting members; and a cam member that is provided for at least one of the plurality of pivoting members, the cam member having a large diameter part and a small diameter part, the cam member being configured to prohibit a corresponding one of the plurality of urging members from applying an urging force to the cleaning member when the large diameter part contacts the pivoting end of the at least one of the plurality of pivoting members, the cam member being configured to allow the corresponding one of the plurality of urging members to apply an urging force to the cleaning member when the small diameter part confronts the pivoting end of the at least one of the plurality of pivoting members.

17. The image forming apparatus according to claim 16, wherein the plurality of pivoting members comprises:

a first pivoting member that supports either one of the cleaning member and the backup member; and a second pivoting member that is configured to pivotally move to contact the first pivoting member, wherein the plurality of urging members comprises:

a first urging member that is provided at the first pivoting member to urge the pivoting end of the first pivoting member; and a second urging member that is provided at the second pivoting member to urge the pivoting end of the second pivoting member, wherein the cam member is configured to move the second pivoting member to separate from the first pivoting member to prohibit the second urging member from applying the urging force to the cleaning member when the large diameter part contacts the pivoting end of the second pivoting member; and wherein the cam member is configured to move the second pivoting member to contact the first pivoting member, to allow the second urging member to apply the urging force to the cleaning member when the small diameter part confronts the pivoting end of the second pivoting member.

18. The image forming apparatus according to claim 16, wherein the plurality of pivoting members comprises:

a first pivoting member that supports either one of the cleaning member and the backup member; and a second pivoting member that is configured to pivotally move about a same axis as the first pivoting member, wherein the plurality of urging members comprises:

a first urging member that is provided at the first pivoting member to urge the pivoting end of the first pivoting member; and a second urging member that is provided at the second pivoting member to urge the pivoting end of the second pivoting member;

wherein the cam member comprises:

a first cam member that is rotatable about a cam shaft and that is configured to contact the first pivoting member; and a second cam member that is rotatable about the cam shaft and that is configured to contact the second pivoting member, wherein the first cam member is configured to prohibit the first urging member from applying the urging force to the cleaning member when the large diameter part contacts the pivoting end of the first pivoting member and is configured to allow the first urging member to apply the urging force to the cleaning member when the small diameter part confronts the pivoting end of the first pivoting member; and wherein the second cam member is configured to prohibit the second urging member from applying the urging force to the cleaning member when the large diameter part contacts the pivoting end of the second pivoting member and is configured to allow the second urging member to apply the urging force to the cleaning member when the small diameter part confronts the pivoting end of the second pivoting member.

* * * * *